US007347523B2

(12) United States Patent
Tatsumi

(10) Patent No.: US 7,347,523 B2
(45) Date of Patent: Mar. 25, 2008

(54) IMAGE RECORDING APPARATUS AND METHOD FOR DETERMINING DEFECTIVE IMAGE-RECORDING ELEMENTS

(75) Inventor: Setsuji Tatsumi, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 269 days.

(21) Appl. No.: 10/909,557

(22) Filed: Aug. 3, 2004

(65) Prior Publication Data

US 2005/0030327 A1 Feb. 10, 2005

(30) Foreign Application Priority Data

Aug. 4, 2003 (JP) ..... 2003-205719

(51) Int. Cl.
*B41J 29/38* (2006.01)
*B41J 29/393* (2006.01)
*B41J 2/205* (2006.01)

(52) U.S. Cl. ..... 347/19; 347/14; 347/15

(58) Field of Classification Search ..... 347/13
See application file for complete search history.

(56) References Cited

U.S. PATENT DOCUMENTS

| | | | | |
|---|---|---|---|---|
| 6,036,300 | A | 3/2000 | Suzuki et al. | |
| 6,517,184 | B1 * | 2/2003 | Bruch et al. | 347/23 |
| 6,547,361 | B1 | 4/2003 | Suzuki et al. | |
| 6,598,953 | B2 * | 7/2003 | Bland | 347/19 |
| 6,604,807 | B1 * | 8/2003 | Murcia et al. | 347/19 |
| 6,652,056 | B2 * | 11/2003 | Shioya | 347/12 |
| 6,764,155 | B2 * | 7/2004 | D'Souza et al. | 347/12 |
| 7,101,011 | B2 * | 9/2006 | Koitabashi et al. | 347/19 |
| 7,201,462 | B2 * | 4/2007 | Shibata et al. | 347/19 |

FOREIGN PATENT DOCUMENTS

| | | | |
|---|---|---|---|
| DE | 3244112 | A1 * | 5/1984 |
| JP | 5-301427 | A | 11/1993 |
| JP | 6-198866 | A | 7/1994 |
| JP | 9-39223 | A | 2/1997 |

* cited by examiner

*Primary Examiner*—Matthew Luu
*Assistant Examiner*—Shelby Fidler
(74) *Attorney, Agent, or Firm*—Birch, Stewart, Kolasch & Birch, LLP

(57) ABSTRACT

The image recording apparatus comprises: a printing device which includes a full-line recording head having a plurality of image-recording elements arranged along a length corresponding to an entire width of a printing medium, the recording head recording an image on the printing medium by the plurality of image-recording elements; a conveying device which moves at least one of the recording head and the printing medium relatively to each other in a conveyance direction substantially perpendicular to a width direction of the printing medium; an image reading device which includes a plurality of sensors outputting actual sensor output data by reading the image recorded on the printing medium, the plurality of sensors being arranged along the length corresponding to the entire width of the printing medium; and a defective image-recording element determining device which determines a defective one of the plurality of image-recording elements by performing computation for each sensor of the plurality of sensors according to the actual sensor output data obtained from the each sensor, the actual sensor output data obtained from one of the plurality of sensors adjacent to the each sensor, and expected sensor output data expected from the image to be normally recorded.

28 Claims, 18 Drawing Sheets

| | | | | |
|---|---|---|---|---|
| 0/0/0 | 0/0/1 | 0/1/2 | 0/0/1 | 0/0/0 |
| 0/0/1 | 0/2/3 | 0/5/8 | 0/2/3 | 0/0/1 |
| 0/1/2 | 0/5/8 | 0/10/15 | 0/5/8 | 0/1/2 |
| 0/0/1 | 0/2/3 | 0/5/8 | 0/2/3 | 0/0/1 |
| 0/0/0 | 0/0/1 | 0/1/2 | 0/0/1 | 0/0/0 |

PAPER CONVEYANCE DIRECTION

NOZZLE ALIGNMENT DIRECTION

IMAGE RECORDING APPARATUS AND METHOD FOR DETERMINING DEFECTIVE IMAGE-RECORDING ELEMENTS

This Non-provisional application claims priority under 35 U.S.C. § 119(a) on Patent Application No(s). 2003-205719 filed in Japan on Aug. 4, 2003, the entire contents of which are hereby incorporated by reference.

BACKGROUND OF THE INVENTION

1. Field of the Invention

The present invention relates to an image recording apparatus and method, and more particularly to an image recording apparatus and method for determining recording defects of an image-recording element in an inkjet recording apparatus or other image recording apparatus for recording images on a printing medium by a recording head having a plurality of image-recording elements, and to a technique for compensating for recording defects thereof.

2. Description of the Related Art

Inkjet recording apparatuses have an inkjet head (print head) in which a large number of nozzles are arranged, and images are formed on recording paper by ejecting ink droplets from the nozzles while moving the print head and the paper relatively to each other. There are cases in which some of the nozzles of the large number of nozzles no longer eject ink for some reason, the amount of ink ejected (the dot size resulting from the ejection of a droplet on the recording paper) and the droplet deposition positions become defective (defective flight direction, non-uniform nozzle positions), and other ejection defects occur. The presence of such defective nozzles causes the quality of the recorded image to be degraded, thus countermeasures thereto are required.

Conventionally, known methods for determining ejection defects in nozzles include (1) a method for measuring a printed test pattern, (2) a method for measuring an actual print job (the printed result of a target image that actually requires printing output), and (3) a method for measuring the characteristics during ejection inside the head.

However, the method (1) for measuring a printed test pattern requires that a special test pattern be printed, which is separate from a target image that actually requires printing. Moreover, there are drawbacks in a simple pattern in that the results are affected by errors in the measurement positions and that it is difficult to determine defective nozzles. Furthermore, there is a drawback in that the results are affected by variability in the output of the line sensor for reading the test pattern.

In the case of the method (2) for measuring an actual print job, the actual print job, which is the measurement object, is usually an intricate image, so that there are drawbacks in that it becomes difficult to determine whether image defects are due to a defective nozzle or to the original image content, and to accurately determine a defective nozzle, due to the effect of errors in the measurement positions. Moreover, the results are affected by variability in the line sensor in the same manner as the above test pattern.

Japanese Patent Application Publication No. 5-301427 discloses an example of the above method (2) whereby the droplet deposition image data and the data to be recorded are compared, and dot deficiencies due to ejection defects are corrected. More specifically, dots on the recording paper are read with photoelectric transducing elements arranged with the same pitch as the pitch of the nozzles of the recording head to detect a non-ejection of ink; however, in this method, when the image has a high density, the sensor output difference with the surroundings is smaller, so that defective ink-droplet ejection cannot be accurately determined by comparing individual dots. In particular, in the case of high-density nozzles used for high resolution image recording, the observation area of each pixel of the line sensor is greater than the nozzle pitch, so that it becomes even more difficult to determine a defective ejection nozzle when the conveyance errors of recording paper and the like are also taken into consideration.

Moreover, the method (3) for measuring the characteristics during ejection inside the head can accurately determine a defective nozzle; however, there is a drawback in that it is difficult to ascertain the degree of deficiency.

SUMMARY OF THE INVENTION

The present invention has been implemented taking into account the above described circumstances, and an object thereof is to provide an image-recording device that can accurately determine a defective image-recording element with recording defects and the condition thereof, and a method of determining a defective image-recording element thereof.

In order to attain the above described object, the present invention is directed to an image recording apparatus, comprising: a printing device which includes a full-line recording head having a plurality of image-recording elements arranged along a length corresponding to an entire width of a printing medium, the recording head recording an image on the printing medium by the plurality of image-recording elements; a conveying device which moves at least one of the recording head and the printing medium relatively to each other in a conveyance direction substantially perpendicular to a width direction of the printing medium; an image reading device which includes a plurality of sensors outputting actual sensor output data by reading the image recorded on the printing medium, the plurality of sensors being arranged along the length corresponding to the entire width of the printing medium; and a defective image-recording element determining device which determines a defective one of the plurality of image-recording elements by performing computation for each sensor of the plurality of sensors according to the actual sensor output data obtained from the each sensor, the actual sensor output data obtained from one of the plurality of sensors adjacent to the each sensor, and expected sensor output data expected from the image to be normally recorded.

In accordance with the present invention, an image is formed on the printing medium by the action of the image-recording elements of the recording head while the printing medium is moved in the sub-scanning direction relatively to the full-line recording head having the row of image-recording elements that cover the entire width of the printing medium in the direction substantially perpendicular to the relative delivering direction (the sub-scanning direction) of the printing medium. When the printed image is read by the image reading device, signals corresponding to the luminous energy received by the sensors (the photoelectric transducing elements) that constitute the pixels of the image-recording device are outputted, and actual sensor output data (data related to actual measurements) for one line in the main scanning direction is obtained. In addition to this, expected sensor output data that is expected as sensor output data for the image is acquired from image information to be recorded normally, computations are performed in which this expected sensor output data and actual sensor output data that is actually measured are used, and the image-recording elements with recording defects (defective image-recording elements) are determined according to the computational result. Here, rather than individually evaluating the actual output data of each sensor, the variation (correlation) in data values is taken into consideration while comparing the actual output data obtained from a plurality of adjacent sensors to perform the evaluation.

The position of defective image-recording elements can be thereby accurately determined even if the number of sensors (number of pixels of the image reading device) and the number of image-recording elements are not the same, even if the sensor position and the image dot position (in other words, the center position of the image-recording element projected in the main scanning direction) are not the same, or even if the array pitch of the sensors projected in the main scanning direction and the array pitch of the image-recording elements projected in the main scanning direction are different.

Moreover, defective image-recording elements are determined using a plurality of data values including not only individual actual output data obtained from each of the sensors, but also actual output data obtained from sensors adjacent to each of the sensors, so that the variability effect of each sensor can be reduced, a determination with good accuracy is possible, and variability in dot positions (displaced recording position) and other recording defects can be efficiently determined from the actual output data obtained from the sensors.

In the present specification, the term "printing" expresses the concept of not only the formation of characters, but also the formation of images with a broad meaning that includes characters.

A "full-line recording head" is normally disposed along the direction perpendicular to the relative delivering direction of the printing medium (the conveyance direction), but also possible is an aspect in which the recording head is disposed along the diagonal direction given a predetermined angle with respect to the direction perpendicular to the conveyance direction. The arrangement of the image-recording elements in the recording head is not limited to a single row array in the form of a line, but a matrix array composed of a plurality of rows is also possible. Furthermore, also possible is an aspect in which a plurality of short-length recording head units having a row of image-recording elements that do not have lengths that correspond to the entire width of the printing medium are combined and the image-recording element rows are configured so as to correspond to the entire width of the printing medium, with these units acting as a whole.

The "printing medium" is a medium (an object that may be referred to as an image formation medium, recording medium, recorded medium, image receiving medium, or the like) that receives the printing of the recording head, and includes continuous paper, cut paper, seal paper, resin sheets such as sheets used for overhead projectors (OHP), film, cloth, and various other media without regard to materials or shapes.

The term "conveying device" includes an aspect in which the printing medium is conveyed with respect to a stopped (fixed) recording head, an aspect in which the recording head is moved with respect to a stopped printing medium, or an aspect in which both the recording head and the printing medium are moved.

An example of the computation in the defective image-recording element determining device is an aspect in which actual data based on the actual sensor output data are compared with the expected sensor output data.

The image recording apparatus according to an aspect of the present invention further comprises an expected sensor output data generating device which generates the expected sensor output data according to dot data generated from data of the image to be recorded, the expected sensor output data generating device including a filtering device which filters the dot data.

In this case, a preferable aspect is one in which the filtering device filters the dot data using a filter having a plurality of types of filter coefficients corresponding to a plurality of types of dot sizes, one of the plurality of types of filter coefficients being selected according to the dot size represented by the dot data.

By selecting a suitable filter coefficient in accordance with the difference in dot size, it is possible to accurately determine a defective image-recording element even if the size of the dot to be recorded has been changed. The coefficient of the filter is preferably selected to reflect the surface area of the dots contained in the read range of each sensor.

The image recording apparatus according to another aspect of the present invention further comprises: an integration computing device which computes integrated data obtained by integrating the actual sensor output data along the conveyance direction through a unit having a length in the conveyance direction not shorter than a predetermined length; an image position determining device which determines a positional relationship of the expected sensor output data and positions of the plurality of sensors corresponding to at least two locations in a main scanning direction substantially perpendicular to the conveyance direction by comparing, according to the integrated data obtained by the integration computing device, image characteristics values around the at least two locations with image characteristics values of integrated data of the expected sensor output data; a positional relationship ascertaining device which ascertains relationship between positions of the plurality of sensors and positions of the plurality of image-recording elements by associating the positions of the plurality of sensors corresponding to the at least two locations determined by the image position determining device and the positions of the plurality of image-recording elements; and an expected sensor output value calculating device which obtains expected sensor output values for the positions of the plurality of sensors by interpolation computation according to the relationship between the positions of the plurality of sensors and the positions of the plurality of image-recording elements ascertained by the positional relationship ascertaining device.

In accordance with this aspect, the positional relationship between the sensor position and the image-recording element position is established, and the positional displacement in the direction of the row of image-recording elements projected in the main scanning direction can be corrected.

For example, there is an aspect in which the correlation between the sensor positions corresponding to both edges of the image and the image-recording element positions is established and the relationship between each sensor position and the image-recording element position is ascertained.

Various techniques can be applied to the interpolation computation, and, as an example, there is an aspect in which the reciprocal of the distance in the main scanning direction from the sensor position to the adjacent image-recording element is set as the weighting coefficient, and the expected sensor output value at each sensor position is obtained by calculating the average weighting of the expected output values of the adjacent image-recording element positions.

The image recording apparatus according to yet another aspect of the present invention further comprises a defective image-recording element position candidate determining device which determines an approximate position of the defective one of the plurality of image-recording elements in accordance with an integral value obtained by integrating the actual sensor output data obtained from the plurality of sensors along the conveyance direction and with an integral value obtained by integrating the expected sensor output values obtained by the expected sensor output value calculating device along the conveyance direction.

Moreover, the image recording apparatus can further comprise a cleaning device which cleans the recording head according to a result of determination of an approximate position of the defective one of the plurality of image-recording elements by the defective image-recording element position candidate determining device.

By integrating the data values in the direction of relative movement of the printing medium, the effect of the read timing of the sensors can been reduced, read errors are equalized, and small differences in the data values can be determined. Furthermore, the luminous energy of the light source illuminating the printing medium can be reduced.

In this aspect, high-frequency defect data can be determined without being slowed by interpolation by directly (without interpolation computation or the like) integrating actual output data values obtained from each sensor.

The image recording apparatus according to yet another aspect of the present invention further comprises an image-recording element state determining device which determines a state of the defective one of the plurality of image-recording elements by comparing an expected sensor output data expected from a recording image when there is a defective image-recording element in a supposed defective state, with the actual sensor output data obtained from the plurality of sensors.

The "defective state" includes inability to record, abnormal dot size, abnormal dot recording position, and other aspects. The "defective state" when the inkjet recording apparatus in which a nozzle for ejecting ink is adopted as the image-recording element includes non-ejection, abnormal ink-droplet ejection size, abnormal ink-droplet deposition position, and other aspects.

The image recording apparatus according to yet another aspect of the present invention further comprises at least one of: a correcting device which corrects an image recording operation according to a result of determination of a defective image-recording element by the defective image-recording element determining device; and a cleaning device which cleans the recording head according to the result of determination of a defective image-recording element by the defective image-recording element determining device.

The image recording apparatus according to yet another aspect of the present invention further comprises a correcting device which performs correction of an image recording operation according to a result of determination of a defective image-recording element by the defective image-recording element determining device; a historical information storage device which stores at least a previous pair of information of the determination of the defective image-recording element and information of the correction of the image recording operation; and a history control device which determines a content of subsequent correction according to the previous pair of information stored in the historical information storage device and information obtained by reading the image after the correction with the image reading device.

In accordance with this aspect, even if the compensation of the defective image-recording element were be inaccurate, the information therefrom is referred to in subsequent processing, and optimal compensation processing can thereby be performed. Thus, the compensation accuracy can be improved by controlling feedback that is based on historical information.

In the image recording apparatus according to yet another aspect of the present invention, the recording head is adapted to record the image in at least colors of cyan (C), magenta (M), and yellow (Y); the image reading device comprises an RGB sensor row adapted to resolve and read red (R) light, green (G) light, and blue (B) light; the RGB sensor reads an image section where the colors are recorded in an overlaid fashion by the printing device; defective image-recording element determining processing is performed in order of the colors of C, M, and Y; and the defective image-recording element determining processing for a subsequent color is performed while removing a location determined to be the defective image-recording element in the defective image-recording element determining processing for a previous color.

The printing device can comprise a plurality of recording heads respectively corresponding to the colors of C, M, and Y, or a single recording head adapted to record an image in a plurality of colors.

In the image recording apparatus according to yet another aspect of the present invention, the recording head is adapted to record the image in at least colors of black (K), cyan (C), magenta (M), and yellow (Y); the image reading device comprises an RGB sensor row adapted to resolve and read red (R) light, green (G) light, and blue (B) light; the RGB sensor reads an image section where the colors are recorded in an overlaid fashion by the printing device; defective image-recording element determining processing is performed in order of the colors of K, C, M, and Y; and the defective image-recording element determining processing for a subsequent color is performed while removing a location determined to be the defective image-recording element in the defective image-recording element determining processing for a previous color.

The printing device can comprise a plurality of recording heads respectively corresponding to the colors of K, C, M, and Y, or a single recording head adapted to record an image in a plurality of colors including K.

In accordance with these aspects, it is possible to efficiently determine a defective image-recording element for each color with good accuracy from an actual image print job.

In order to attain the above described object, the present invention is also directed to a method for determining a defective image-recording element in an image recording apparatus, comprising: recording an image on a printing medium by a full-line recording head having a plurality of image-recording elements arranged along a length corresponding to an entire width of the printing medium; reading the image recorded on the printing medium by a reading device including a plurality of sensors outputting actual sensor output data, the plurality of sensors being arranged along the length corresponding to the entire width of the printing medium; and determining a defective one of the plurality of image-recording elements by performing computation for each sensor of the plurality of sensors according to the actual sensor output data obtained from the each sensor, the actual sensor output data obtained from one of the plurality of sensors adjacent to the each sensor, and expected sensor output data expected from the image to be normally recorded.

In accordance with the present invention described above, the image printed by a full-line recording head having a plurality of image-recording elements arranged along a length corresponding to the entire width of the printing medium in the main scanning direction that is substantially perpendicular to the direction of relative movement of the printing medium is read by the image reading device having a plurality of sensors arranged along the length corresponding to the entire width of the same recording medium, and defective image-recording elements are determined according to the actual output data obtained from the sensors, so that defective image-recording elements can be determined with good accuracy not only when the number of the sensors and the number of the image-recording elements are the same, but also when the number of the sensors and the number of the image-recording elements are not the same. Moreover, in the present invention, it is capable of handling cases such as when the sensor positions and the dot positions of the image are not the same, or when the array pitch of the sensors projected in the main scanning direction and the array pitch of the image-recording elements projected in the main scanning direction are different.

Moreover, in the present invention, defective image-recording elements are determined using the actual output data obtained from the sensors that are in a mutually adjacent relationship, so that the effect of variability in individual sensors can be reduced, determination can be made with good accuracy, and variability (recording position displacement) in the recording position, and other recording defects can be efficiently determined from the actual output data obtained from the sensors.

Furthermore, in the present invention, by integrating the data values in the direction of relative movement of the printing medium, the effect of the read timing of the sensors can been reduced, read errors are equalized, small differences in the data values can be determined, and the accuracy of determining defective image-recording elements is improved.

The method for determining defective image-recording elements in accordance with one aspect of the present invention makes a determination that is based on a comparison of the data to be recorded and the measured data, so that a determination can be made not only with a test pattern (test print), but also with an actual print job.

In another aspect of the present invention, feedback control is added to modify the subsequent compensation contents by means of at least the previous historical information, so that even if the compensation were to be inaccurate in the previous compensation processing, the same error compensation can be prevented from being performed in the subsequent processing step, and optimal compensation can be performed.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Configuration of an Inkjet Recording Apparatus

Figure 1:
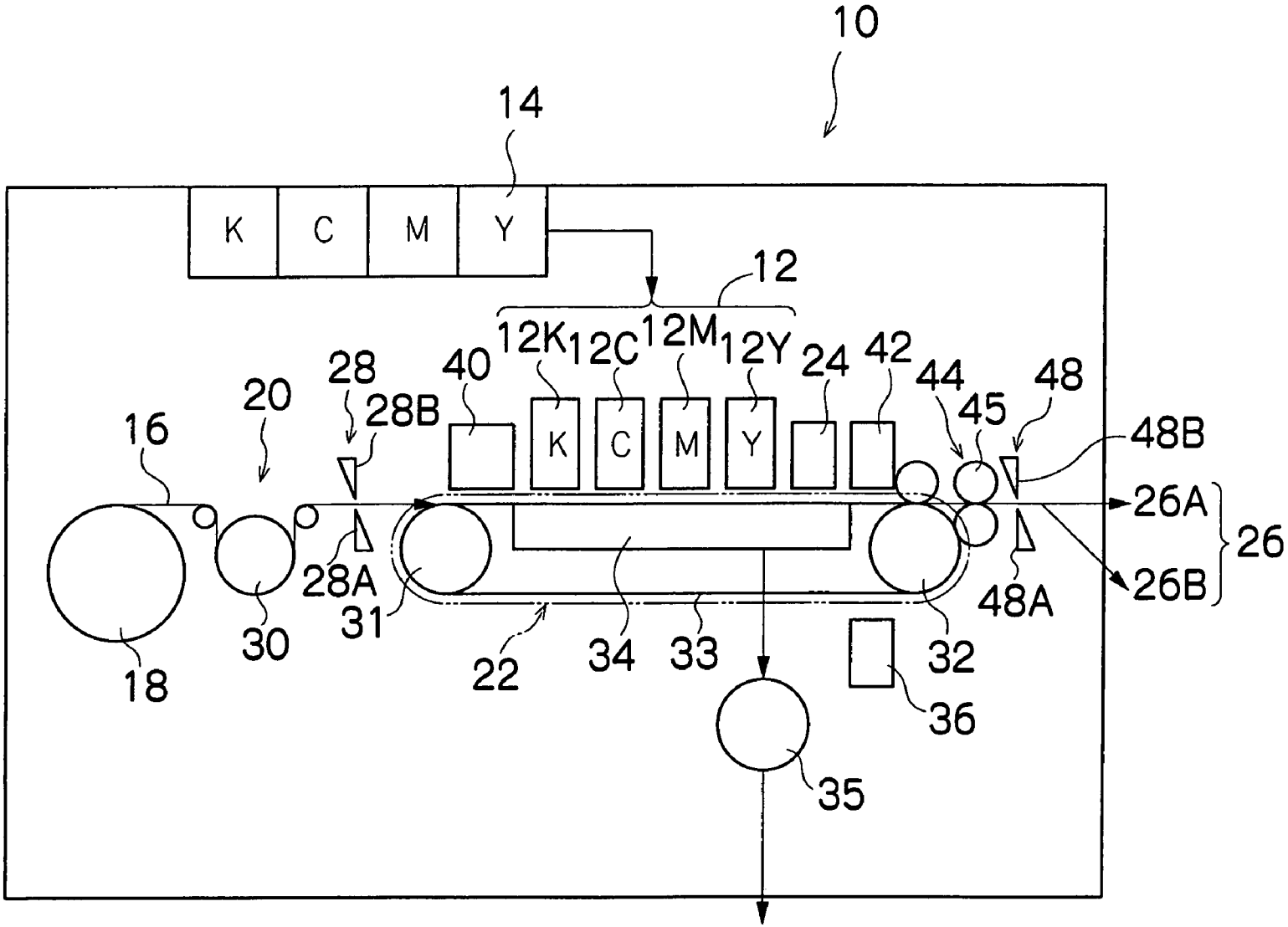
FIG. 1 is a general schematic drawing of an inkjet recording apparatus according to an embodiment of the present invention.

FIG. 1 is a general schematic drawing of an inkjet recording apparatus according to an embodiment of the present invention. As shown in FIG. 1, the inkjet recording apparatus 10 comprises: a printing unit 12 having a plurality of print heads 12K, 12C, 12M, and 12Y for ink colors of black (K), cyan (C), magenta (M), and yellow (Y), respectively; an ink storing/loading unit 14 for storing inks to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a single magazine for rolled paper (continuous paper) is shown as an example of the paper supply unit 18; however, a plurality of magazines with paper differences such as paper width and quality may be jointly provided. Moreover, paper may be supplied with a cassette that contains cut paper loaded in layers and that is used jointly or in lieu of a magazine for rolled paper.

In the case of a configuration in which a plurality of types of recording paper can be used, it is preferable that a information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is equal to or greater than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut paper is used, the cutter 28 is not required.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1; and the suction chamber 34 provides suction with a fan 35 to generate a negative pressure, and the recording paper 16 is held on the belt 33 by suction. The belt 33 is driven in the clockwise direction in FIG. 1 by the motive force of a motor (not shown in FIG. 1, but shown as a motor 88 in FIG. 7) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not depicted, examples thereof include a configuration in which the belt 33 is nipped with a cleaning roller such as a brush roller and a water absorbent roller, an air blow configuration in which clean air is blown onto the belt 33, or a combination of these. In the case of the configuration in which the belt 33 is nipped with the cleaning roller, it is preferable to make the line velocity of the cleaning roller different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
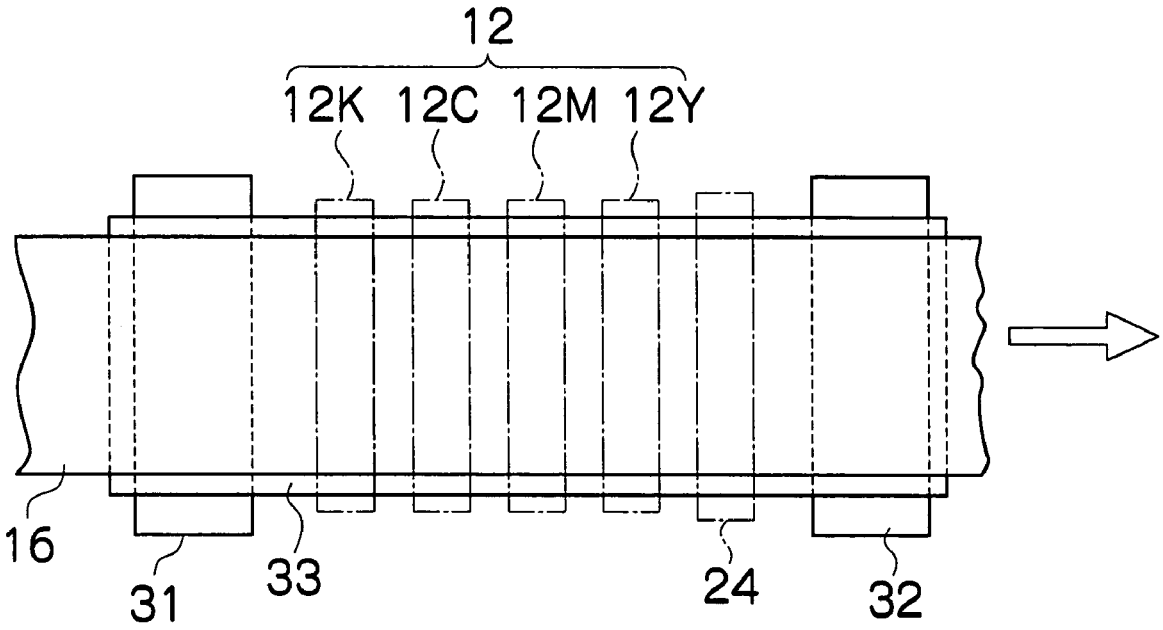
FIG. 2 is a plan view of principal components of an area around a printing unit of the inkjet recording apparatus in FIG. 1.

As shown in FIG. 2, the printing unit 12 forms a so-called full-line head in which a line head having a length that corresponds to the maximum paper width is disposed in the main scanning direction perpendicular to the delivering direction of the recording paper 16 (hereinafter referred to as the paper conveyance direction) represented by the arrow in FIG. 2, which is substantially perpendicular to a width direction of the recording paper 16. A specific structural example is described later with reference to FIGS. 3A to 5. Each of the print heads 12K, 12C, 12M, and 12Y is composed of a line head, in which a plurality of ink-droplet ejection apertures (nozzles) are arranged along a length that exceeds at least one side of the maximum-size recording paper 16 intended for use in the inkjet recording apparatus 10, as shown in FIG. 2.

The print heads 12K, 12C, 12M, and 12Y are arranged in this order from the upstream side along the paper conveyance direction. A color print can be formed on the recording paper 16 by ejecting the inks from the print heads 12K, 12C, 12M, and 12Y, respectively, onto the recording paper 16 while conveying the recording paper 16.

Although the configuration with the KCMY four standard colors is described in the present embodiment, combinations of the ink colors and the number of colors are not limited to those, and light and/or dark inks can be added as required. For example, a configuration is possible in which print heads for ejecting light-colored inks such as light cyan and light magenta are added. Moreover, a configuration is possible in which a single print head adapted to record an image in the colors of CMY or KCMY is used instead of the plurality of print heads for the respective colors.

The print unit 12, in which the full-line heads covering the entire width of the paper are thus provided for the respective ink colors, can record an image over the entire surface of the recording paper 16 by performing the action of moving the recording paper 16 and the print unit 12 relatively to each other in the sub-scanning direction just once (i.e., with a single sub-scan). Higher-speed printing is thereby made possible and productivity can be improved in comparison with a shuttle type head configuration in which a print head reciprocates in the main scanning direction.

As shown in FIG. 1, the ink storing/loading unit 14 has tanks for storing the inks to be supplied to the print heads 12K, 12C, 12M, and 12Y, and the tanks are connected to the print heads 12K, 12C, 12M, and 12Y through channels (not shown), respectively. The ink storing/loading unit 14 has a warning device (e.g., a display device, an alarm sound generator) for warning when the remaining amount of any ink is low, and has a mechanism for preventing loading errors among the colors.

The print determination unit 24 has an image sensor for capturing an image of the ink-droplet deposition result of the print unit 12, and functions as a device to check for ejection defects such as clogs of the nozzles in the print unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern printed with the print heads 12K, 12C, 12M, and 12Y for the respective colors, and the ejection of each head is determined. The ejection determination includes the presence of the ejection, measurement of the dot size, and measurement of the dot deposition position. The details of the ejection determination are described later.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathway in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, a sorter for collecting prints according to print orders is provided to the paper output unit 26A for the target prints.

Next, the structure of the print heads is described. The print heads 12K, 12C, 12M, and 12Y provided for the ink colors have the same structure, and a reference numeral 50 is hereinafter designated to any of the print heads 12K, 12C, 12M, and 12Y.

Figure 3A:
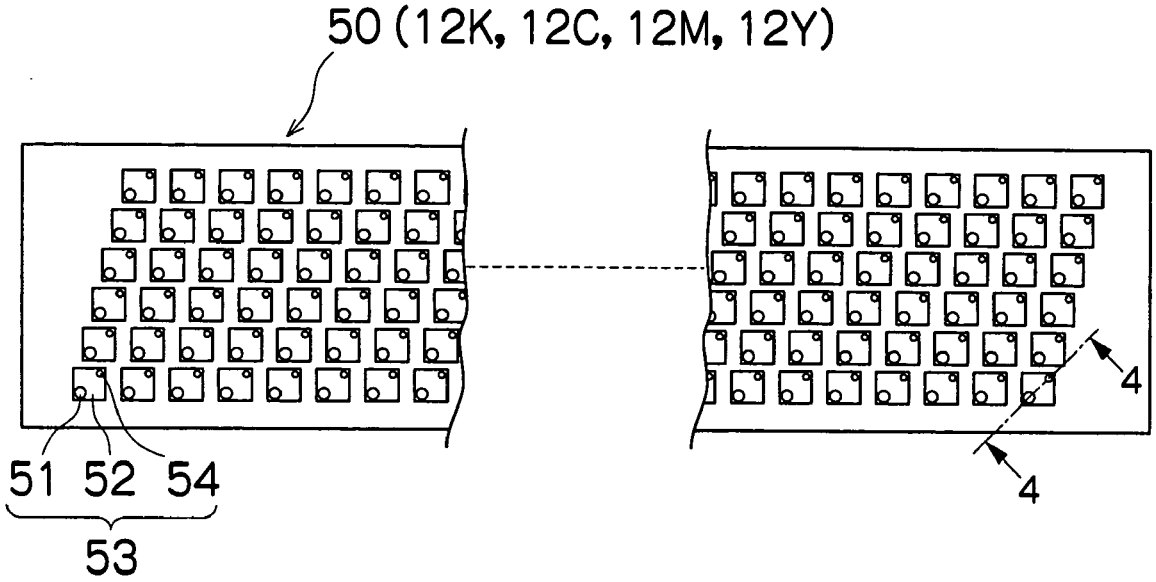
FIG. 3A is a perspective plan view showing an example of a configuration of a print head.
Figure 3B:
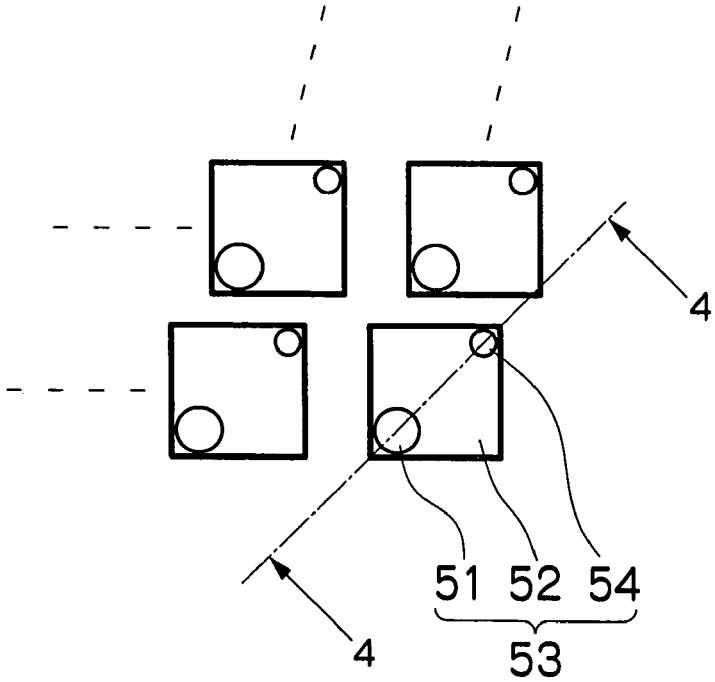
FIG. 3B is a partial enlarged view of FIG. 3A.
Figure 4:
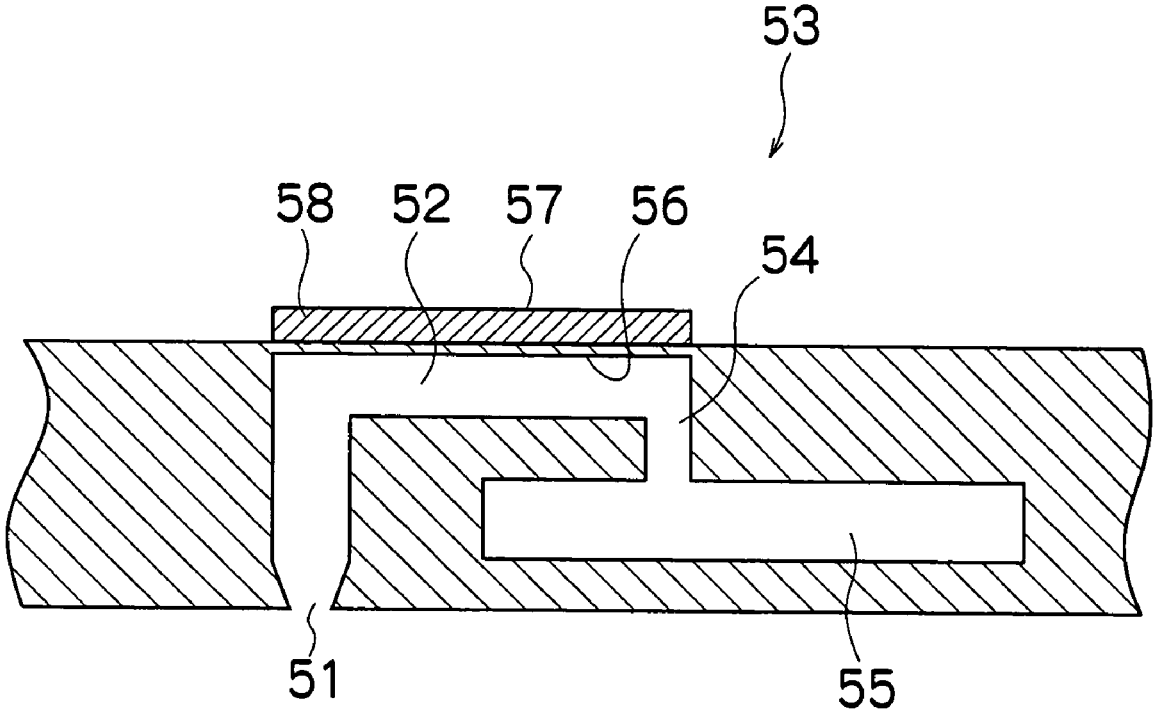
FIG. 4 is a cross-sectional view along a line 4-4 in FIGS. 3A and 3B.

FIG. 3A is a perspective plan view showing an example of the configuration of the print head 50, FIG. 3B is an enlarged view of a portion thereof, and FIG. 4 is a cross-sectional view taken along the line 4-4 in FIGS. 3A and 3B, showing the inner structure of an ink chamber unit. The nozzle pitch in the print head 50 should be minimized in order to maximize the density of the dots printed on the surface of the recording paper. As shown in FIGS. 3A, 3B and 4, the print head 50 in the present embodiment has a structure in which a plurality of ink chamber units 53 including nozzles 51 for ejecting ink-droplets and pressure chambers 52 connecting to the nozzles 51 are disposed in the form of a staggered matrix, and the effective nozzle pitch is thereby made small.

The planar shape of the pressure chamber 52 provided for each nozzle 51 is substantially a square, and the nozzle 51 and supply port 54 are disposed in both corners on a diagonal line of the square. Each pressure chamber 52 is connected to a common channel 55 through a supply port 54.

An actuator 58 having a discrete electrode 57 is joined to a pressure plate 56, which forms the ceiling of the pressure chamber 52, and the actuator 58 is deformed by applying drive voltage to the discrete electrode 57 to eject ink from the nozzle 51. When ink is ejected, new ink is delivered from the common flow channel 55 through the supply port 54 to the pressure chamber 52.

Figure 5:
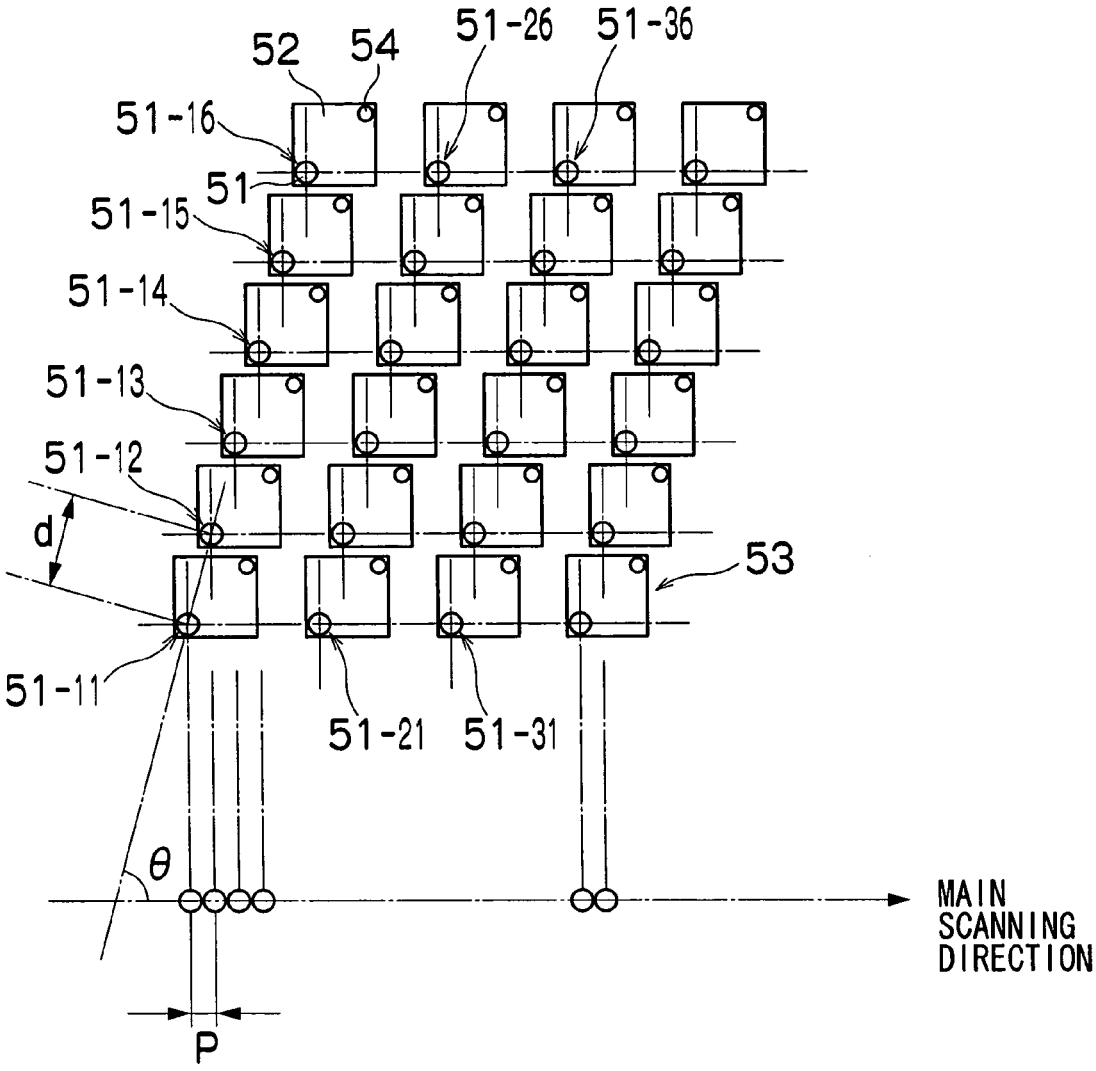
FIG. 5 is an enlarged view showing nozzle arrangement of the print head in FIG. 3A.

The plurality of ink chamber units 53 having such a structure are arranged in a grid with a fixed pattern in the line-printing direction along the main scanning direction and in the diagonal-row direction forming a fixed angle θ that is not a right angle with the main scanning direction, as shown in FIG. 5. With the structure in which the plurality of rows of ink chamber units 53 are arranged at a fixed pitch d in the direction at the angle θ with respect to the main scanning direction, the nozzle pitch P as projected in the main scanning direction is $d \times \cos\theta$.

Hence, the nozzles 51 can be regarded to be equivalent to those arranged at a fixed pitch P on a straight line along the main scanning direction. Such configuration results in a nozzle structure in which the nozzle row projected in the main scanning direction has a high density of up to 2,400 nozzles per inch. For convenience in description, the structure is described below as one in which the nozzles 51 are arranged at regular intervals (pitch P) in a straight line along the lengthwise direction of the head 50, which is parallel with the main scanning direction.

In a full-line head comprising rows of nozzles that have a length corresponding to the maximum recordable width, the "main scanning" is defined as to print one line (a line formed of a row of dots, or a line formed of a plurality of rows of dots) in the width direction of the recording paper (the direction perpendicular to the delivering direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other.

In particular, when the nozzles 51 arranged in a matrix such as that shown in FIG. 5 are driven, the main scanning according to the above-described (3) is preferred. More specifically, the nozzles 51-11, 51-12, 51-13, 51-14, 51-15 and 51-16 are treated as a block (additionally; the nozzles 51-21, 51-22, . . . , 51-26 are treated as another block; the nozzles 51-31, 51-32, . . . , 51-36 are treated as another block, . . . ); and one line is printed in the width direction of the recording paper 16 by sequentially driving the nozzles 51-11, 51-12, . . . , 51-16 in accordance with the conveyance velocity of the recording paper 16.

On the other hand, the "sub-scanning" is defined as to repeatedly perform printing of one line (a line formed of a row of dots, or a line formed of a plurality of rows of dots) formed by the main scanning, while moving the full-line head and the recording paper relatively to each other.

In the implementation of the present invention, the structure of the nozzle arrangement is not particularly limited to the examples shown in the drawings. Moreover, the present embodiment adopts the structure that ejects ink-droplets by deforming the actuator 58 such as a piezoelectric element; however, the implementation of the present invention is not particularly limited to this. Instead of the piezoelectric inkjet method, various methods may be adopted including a thermal inkjet method in which ink is heated by a heater or another heat source to generate bubbles, and ink-droplets are ejected by the pressure thereof.

Figure 6:
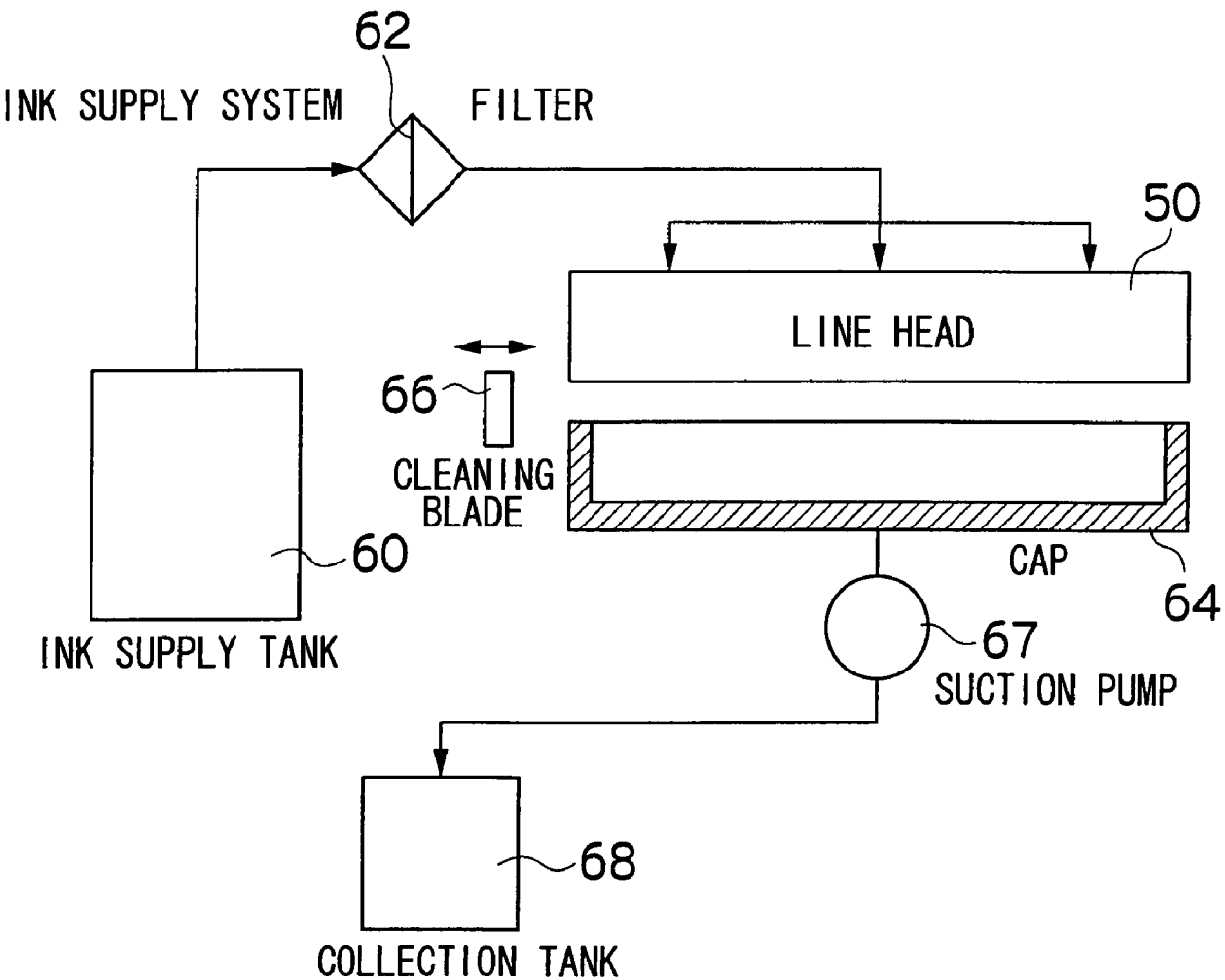
FIG. 6 is a schematic drawing showing a configuration of an ink supply system in the inkjet recording apparatus.

FIG. 6 is a schematic drawing showing the configuration of the ink supply system in the inkjet recording apparatus 10.

An ink supply tank 60 is a base tank that supplies ink and is set in the ink storing/loading unit 14 described with reference to FIG. 1. The aspects of the ink supply tank 60 include a refillable type and a cartridge type: when the remaining amount of ink is low, the ink supply tank 60 of the refillable type is filled with ink through a filling port (not shown) and the ink supply tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink supply tank 60 in FIG. 6 is equivalent to the ink storing/loading unit 14 in FIG. 1 described above.

A filter 62 for removing foreign matters and bubbles is disposed between the ink supply tank 60 and the print head 50, as shown in FIG. 6. The filter mesh size in the filter 62 is preferably equivalent to or less than the diameter of the nozzle and commonly about 20μm.

Although not shown in FIG. 6, it is preferable to provide a sub-tank integrally to the print head 50 or nearby the print head 50. The sub-tank has a damper function for preventing variation in the internal pressure of the head and a function for improving refilling of the print head.

The inkjet recording apparatus 10 is also provided with a cap 64 as a device to prevent the nozzle 51 from drying out or to prevent an increase in the ink viscosity in the vicinity of the nozzles, and a cleaning blade 66 as a device to clean the nozzle face. A maintenance unit including the cap 64 and the cleaning blade 66 can be moved in a relative fashion with respect to the print head 50 by a movement mechanism (not shown), and is moved from a predetermined holding position to a maintenance position below the print head 50 as required.

The cap 64 is displaced up and down in a relative fashion with respect to the print head 50 by an elevator mechanism (not shown). When the power of the inkjet recording apparatus 10 is switched OFF or when in a print standby state, the cap 64 is raised to a predetermined elevated position so as to come into close contact with the print head 50, and the nozzle face is thereby covered with the cap 64.

If the frequency of use of a certain nozzle 51 is low and the ink viscosity in the vicinity of the nozzle has increased while printing or during standby, a preparatory ejection is performed from the nozzle toward the cap 64 to eliminate the degraded ink.

When bubbles have become mixed into the ink (inside the pressure chamber 52) inside the print head 50, the cap 64 is placed on the print head 50, the ink (ink in which bubbles have been mixed) inside of the pressure chamber 52 is removed by suction with a suction pump 67, and the suction-removed ink is sent to a collection tank 68. This suction action is also performed when ink is initially loaded into the head, and when starting service after a long period on non-use to suction off of the degraded ink.

The cleaning blade 66 is composed of an elastic member such as rubber, and can be slid on the ink-droplet ejection surface (surface of the nozzle plate) of the print head 50 by a blade movement mechanism (not shown). When ink spray or foreign matters adhere to the nozzle plate, the nozzle plate surface is wiped and the nozzle plate surface cleaned by sliding the cleaning blade 66 on the nozzle plate.

Figure 7:
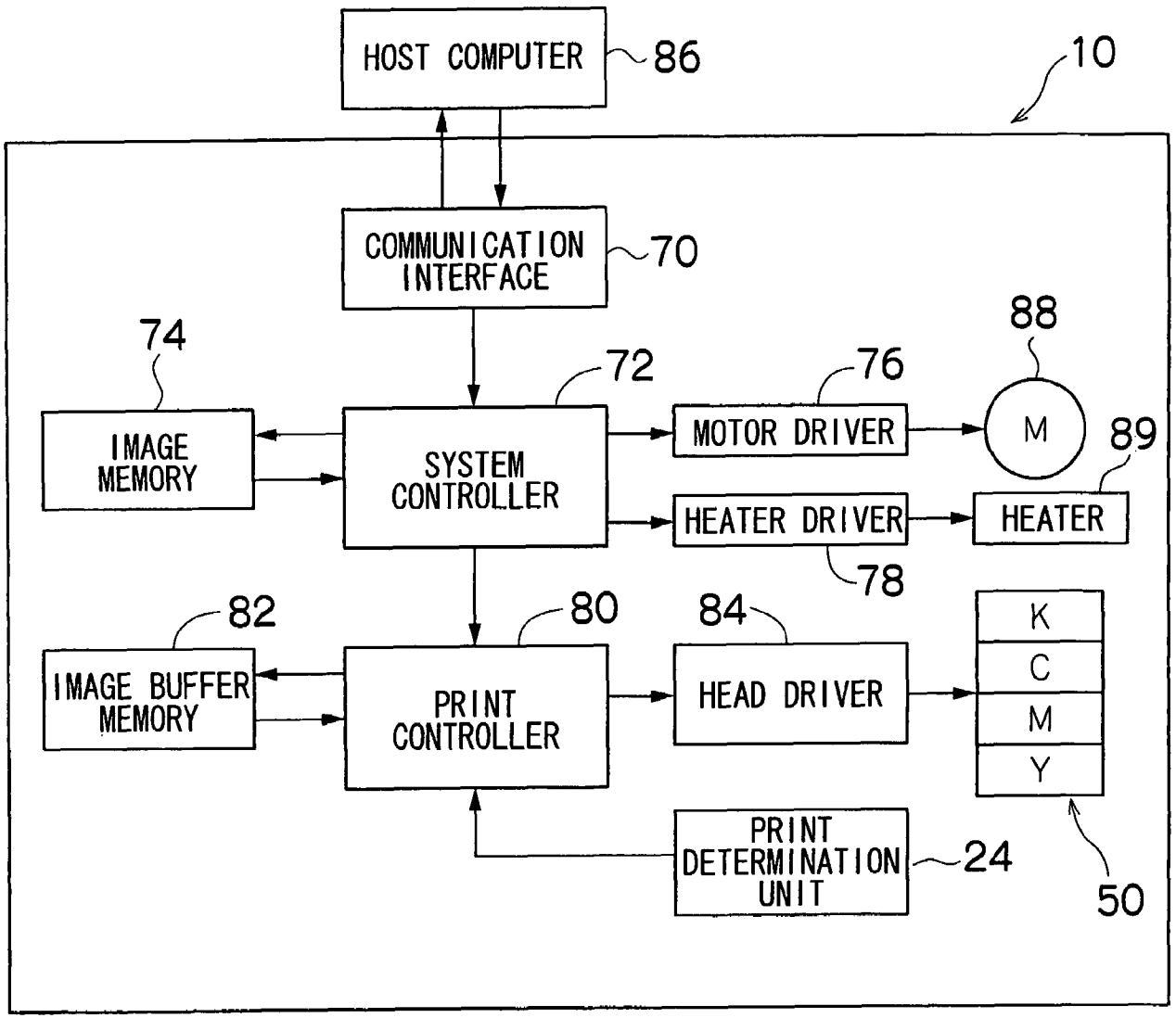
FIG. 7 is a block diagram of principal components showing a system configuration of the inkjet recording apparatus.

FIG. 7 is a block diagram of the principal components showing the system configuration of the inkjet recording apparatus 10. The inkjet recording apparatus 10 has a communication interface 70, a system controller 72, an image memory 74, a motor driver 76, a heater driver 78, a print controller 80, an image buffer memory 82, a head driver 84, and other components.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to memory composed of a semiconductor element, and a hard disk drive or another magnetic medium may be used.

The system controller 72 controls the communication interface 70, image memory 74, motor driver 76, heater driver 78, and other components. The system controller 72 has a central processing unit (CPU), peripheral circuits therefor, and the like. The system controller 72 controls communication between itself and the host computer 86, controls reading and writing from and to the image memory 74, and performs other functions, and also generates control signals for controlling a heater 89 and the motor 88 in the conveyance system.

The motor driver (drive circuit) 76 drives the motor 88 in accordance with commands from the system controller 72. The heater driver (drive circuit) 78 drives the heater 89 of the post-drying unit 42 or the like in accordance with commands from the system controller 72.

The print controller 80 has a signal processing function for performing various tasks, compensations, and other types of processing for generating print control signals from the image data stored in the image memory 74 in accordance with commands from the system controller 72 so as to apply the generated print control signals (print data) to the head driver 84. Required signal processing is performed in the print controller 80, and the ejection timing and ejection amount of the ink-droplets from the print head 50 are controlled by the head driver 84 on the basis of the image data. Desired dot sizes and dot placement can be brought about thereby.

The print controller 80 is provided with the image buffer memory 82; and image data, parameters, and other data are temporarily stored in the image buffer memory 82 when image data is processed in the print controller 80. The aspect shown in FIG. 7 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives actuators for the print heads 12K, 12C, 12M, and 12Y of the respective colors on the basis of the print data received from the print controller 80. A feedback control system for keeping the drive conditions for the print heads constant may be included in the head driver 84.

The print determination unit 24 is a block that includes the line sensor as described above with reference to FIG. 1, reads the image printed on the recording paper 16, determines the print conditions (presence of the ejection, variation in the dot deposition, and the like) by performing desired signal processing, or the like, and provides the determination results of the print conditions to the print controller 80.

The print controller 80 makes various compensation with respect to the print head 50 as required on the basis of the information obtained from the print determination unit 24.

Figure 8:
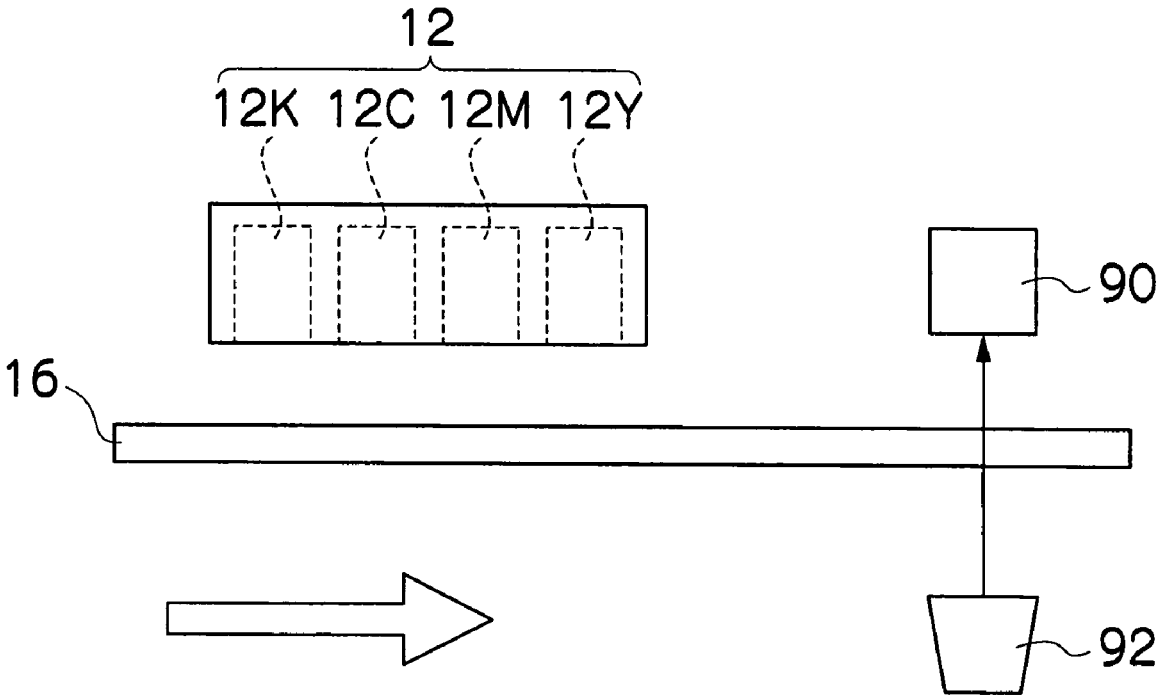
FIG. 8 is a drawing showing an example of another arrangement of a light source for illumination.

In the embodiment shown in FIG. 1, a configuration is adopted in which the print determination unit 24 is disposed on the printed surface side, the printed surface is illuminated by a cold-cathode tube or other light source (not shown) disposed in the vicinity of the line sensor, and the light reflected on the printed surface is read with the line sensor. However, as shown in FIG. 8, also possible in the implementation of the present invention is a configuration in which a line sensor 90 and a light source 92 are set facing each other across the conveyance pathway of the recording paper 16, the light source 92 emits light from the reverse side of the recording paper 16 (opposite of the surface on which ink-droplets are deposited); and the amount of light transmitted through the recording paper 16 is read with the line sensor 90. The configuration with the transmission-type determination shown in FIG. 8 has an advantage in that the image blur acquired by the line sensor can be reduced in comparison with the configuration with the reflection-type determination.

However, in the case of the transmission-type configuration, the amount of light that enters the line sensor can be less than in the reflection-type configuration. Situations can be envisioned in which the amount of incident light is reduced in the reflection-type configuration as well. In either case, when the amount of light that enters the line sensor is small, an adequate determination signal cannot be obtained; however, since high resolution in the paper conveyance direction is not required when an image is read with the line sensor, the situation can be handled by lengthening the charge accumulation time of the line sensor, or by integrating the obtained data in the paper conveyance direction.

The read start timing for the line sensor is determined from the distance between the line sensor and the nozzles and the conveyance velocity of the recording paper 16.

Problems in the Determination of Defective Nozzles

Before describing the method of determining defective nozzles in the inkjet recording apparatus 10 according to the present embodiment, the technical aspects of the problems in determining defective nozzles are discussed first, with reference to FIGS. 9 to 12.

Figure 9:
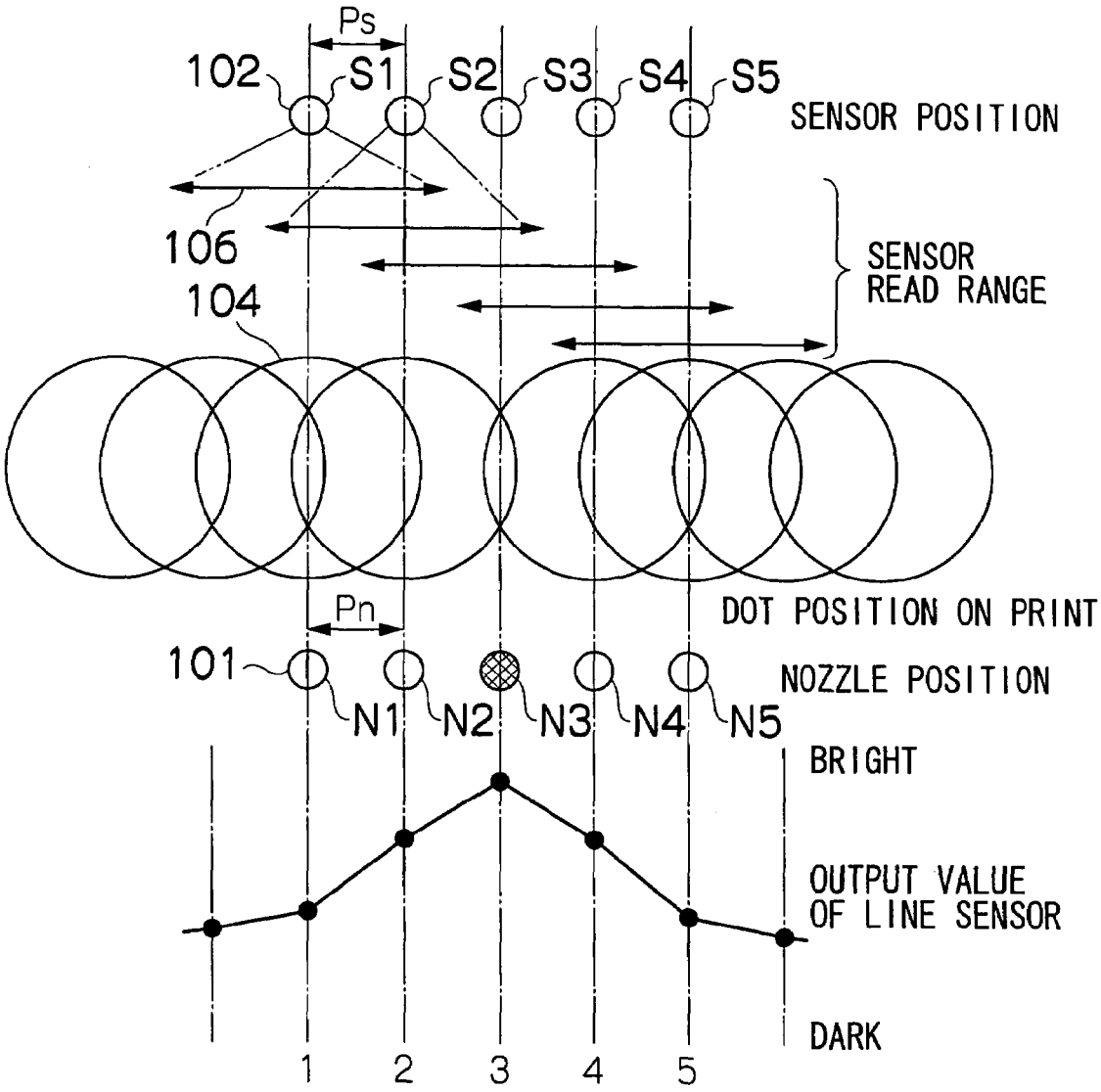
FIG. 9 is a drawing exemplifying relationship between nozzle positions, dot positions, sensor (pixel) positions, and sensor output values when the number of sensors, the number of nozzles, and the array pitches thereof are the same.

FIG. 9 is a drawing exemplifying the relationship among the nozzle positions, the positions of the dots deposited on the recording paper by the nozzles, the positions of the sensors (pixels) for reading the image formed by the dots, and the sensor output values. FIG. 9 shows an example in which the number of nozzles 101 is equal to the number of sensors 102 (the number of pixels in the line sensor), that is, the nozzle pitch Pn is equal to the sensor pitch Ps, and the nozzles 101 and the sensors 102 are arranged relatively to each other to have a one-to-one correspondence.

In the case of high-density nozzles, the size of the dots 104 is larger than the nozzle pitch Pn, and the dots deposited by the neighboring nozzles partially overlap each other, as shown in FIG. 9.

Each of the sensors 102 has a comparatively large read range, as represented by a double-headed arrow 106 in FIG. 9. The output value of the sensor 102 is hence affected by not only the dot deposited by the nozzle 101 corresponding to the sensor 102 but also the dots deposited by the nozzles in the vicinity of the corresponding nozzle 101.

In FIG. 9, the nozzle N3 the third from the left-hand side does not eject ink, and the dot that should have been deposited by the nozzle N3 is missing from the print job. As for the sensor output values obtained when an image formed by the row of nozzles containing the defective nozzle N3 is captured by the line sensor, the output value of the sensor S3 the third from the left-hand side is the highest, and the output values of the neighboring sensors thereof (the second and fourth sensors S2 and S4) are also higher than those of the other sensors.

Thus, simply evaluating each of the output values of the sensors S1 to S5 independently would mislead to the conclusion that not only the third nozzle N3 but also the second and fourth nozzles N2 and N4 have ejection defect, and it is impossible to accurately determine which nozzle is defective.

Figure 10:
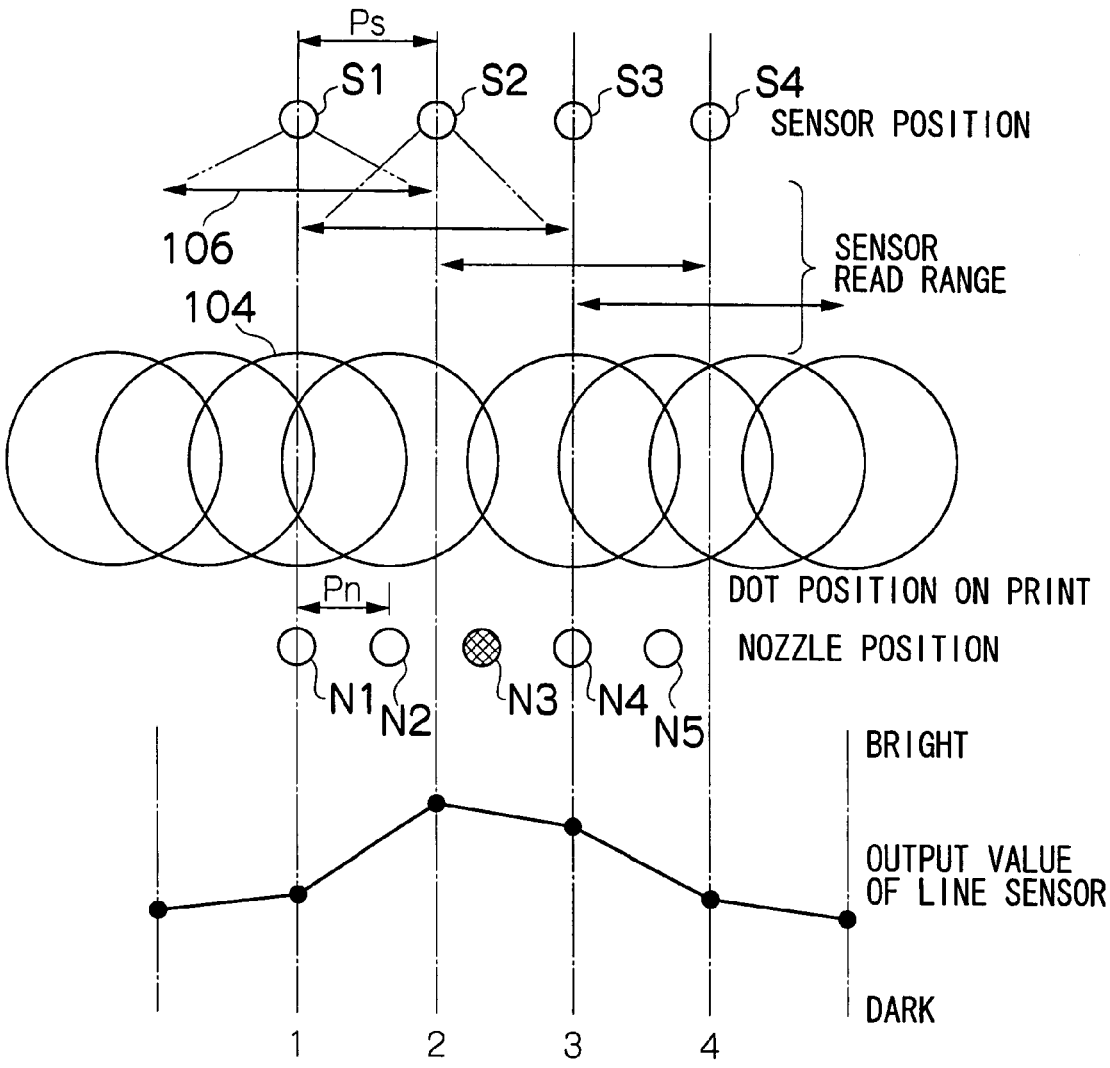
FIG. 10 is a drawing exemplifying relationship between nozzle positions, dot positions, sensor (pixel) positions, and sensor output values when the number of sensors and the number of nozzles are not the same.

FIG. 10 shows an example in which the number of the sensors is different than the number of the nozzles, and the sensor pitch Ps is 1.5 times greater than the nozzle pitch Pn. Corresponding to this example is a case in which the nozzle density projected in the main scanning direction is 2,400 units per inch (2,400 nozzles/inch), and the pixel density in the line sensor is 1,600 units per inch (1,600 dots/inch), for example.

As shown in FIG. 10, when the nozzle N3 the third from the left-hand side is defective, the output values from the sensors nearby the defective nozzle N3 (the sensors S2 and S3 the second and third from the left-hand side in FIG. 10) are higher than those of the other sensors. However, the change of the sensor output values is gentle overall in FIG. 10, as is apparent when compared with the graph in FIG. 9, and it is difficult to detect a clear peak in the graph in FIG. 10. Thus, it is difficult to accurately determine which nozzle is defective.

Figure 11:
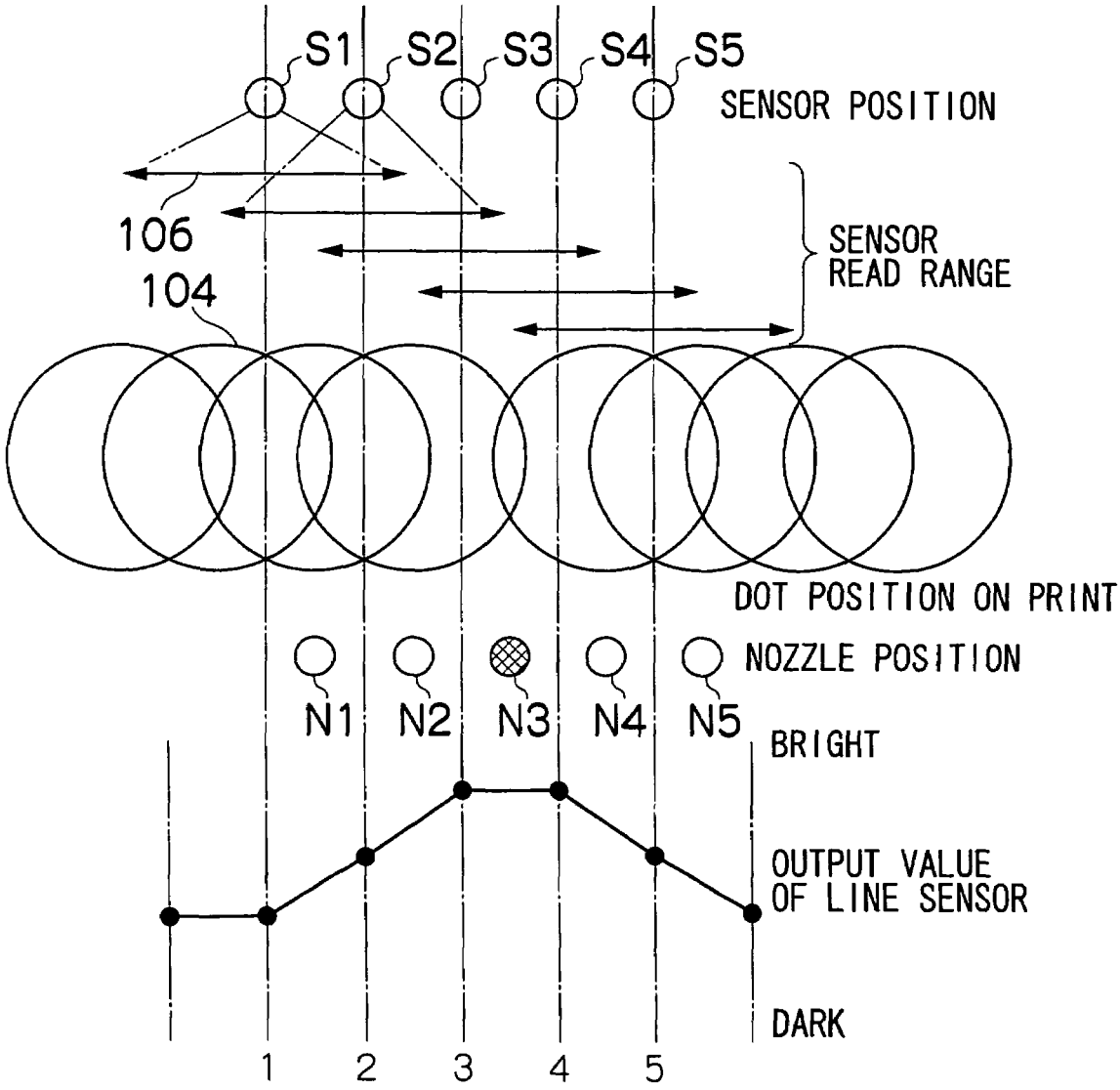
FIG. 11 is a drawing exemplifying relationship between nozzle positions, dot positions, sensor (pixel) positions, and sensor output values when the nozzle positions and the sensor positions are displaced.

FIG. 11 shows an example in which the number of sensors is equal to the number of nozzles, but the center positions of the sensors (pixels) are displaced from those of the nozzles when projected and viewed in the main scanning direction. In other words, the sensors are positioned in the spaces between the neighboring nozzles when projected and viewed in the main scanning direction in FIG. 11.

As shown in FIG. 11, when the nozzle N3 the third from the left-hand side is defective, the output values of the sensors S3 and S4 the third and fourth from the left-hand side are equal to each other and the highest, and the output values of the sensors S2 and S5 adjacent thereto are also somewhat higher than the normal output level. Thus, it is impossible to accurately determine which nozzle is defective by simply evaluating each of the sensor output values independently.

Figure 12:
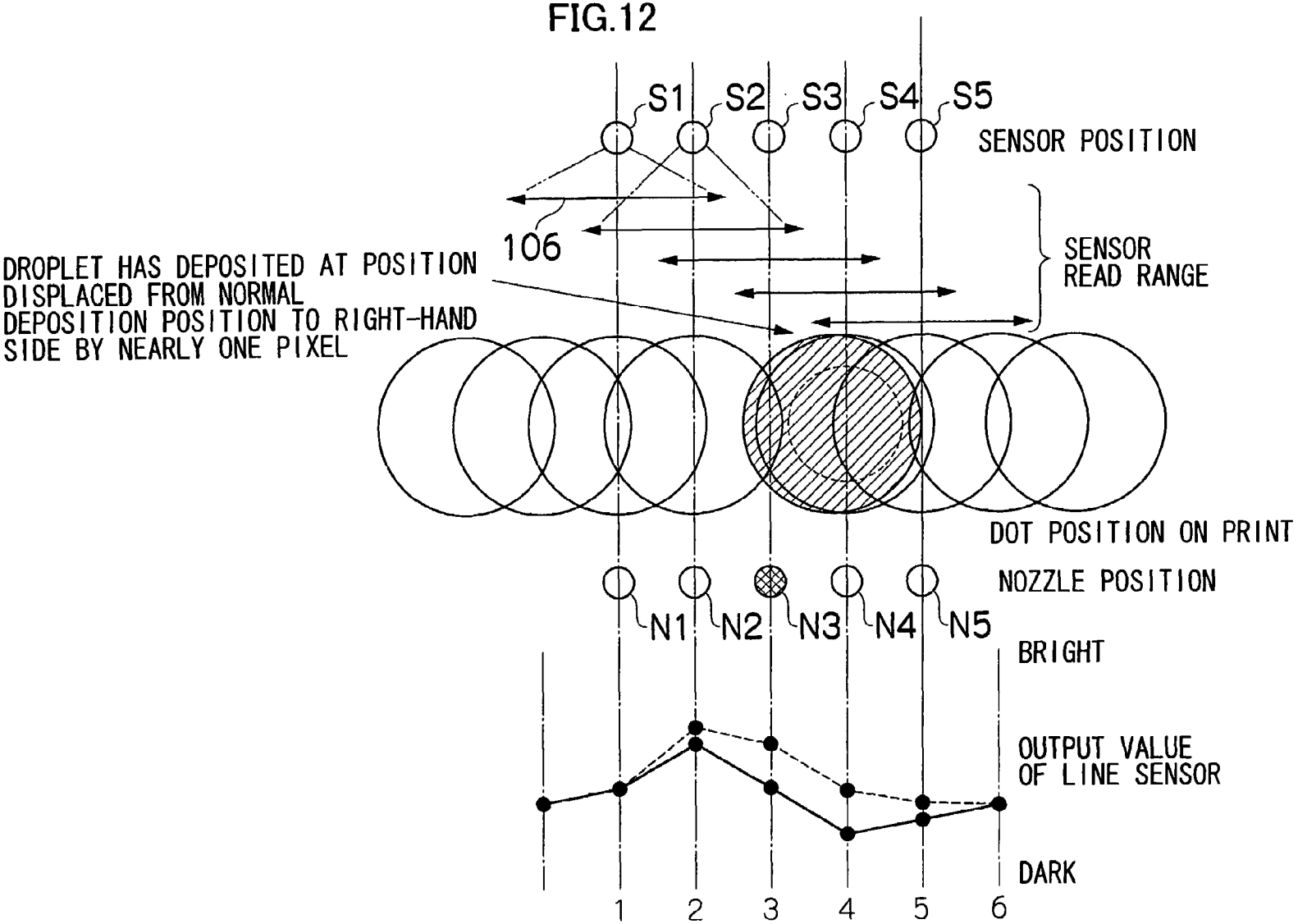
FIG. 12 is a drawing exemplifying relationship between nozzle positions, dot positions, sensor (pixel) positions, and sensor output values when variability in ink-droplet deposition position or an abnormal ink-droplet ejection amount has occurred.

FIG. 12 shows an example in which the number of sensors is equal to the number of nozzles, the center positions thereof are the same, and there is scatteration in the ink-droplet deposition positions (displacement of the flight direction of the ink-droplets) and abnormality in the ink-droplet ejection amounts. In FIG. 12, the ink-droplet ejected from the nozzle N3 the third from the left-hand side has been deposited at a position displaced from the normal deposition position to the right-hand side by nearly one pixel. In this case, the output value of the sensor S2 the second from the left-hand side is the highest, as shown with the solid line in the graph in FIG. 12.

Hence, if focus is placed solely on the output value of the second sensor S2, then there is a possibility that an incorrect determination will be made that the ink-droplet ejection amount of the corresponding nozzle N2 is abnormally small (the ink-droplet size is abnormally small). When compensation control that increases the ink-droplet ejection amount of the corresponding nozzle is performed according to such an incorrect determination, there is a possibility that the compensation will aggravate line blurring (a stain in the form of a straight line along the sub-scanning direction).

There is also a case in which a decrease in the ink-droplet ejection amount occurs simultaneously with scatteration in the ink-droplet deposition positions, as shown with the dashed circle in FIG. 12. The output values of the line sensor in such a case are shown with the dashed line in FIG. 12. In this case as well, there is a possibility that the second nozzle may be incorrectly determined as defective, and because the output value of the third sensor is comparatively high as well as the second sensor, there is a possibility that the third nozzle may also be incorrectly determined as defective.

As described above with reference to FIGS. 9 to 12, it is difficult to accurately determine the position and condition of a defective nozzle by solely determining the output of each of the pixels of the line sensor on an individual basis.

Based on the above considerations, the inkjet recording apparatus 10 according to the present embodiment is configured so as to take into consideration the overlap of neighboring dots and the read range of each sensor, to evaluate the condition of the nozzles from the output of a plurality of pixels (sensors), and to determine defective nozzles and their conditions.

Method of Determining Defective Nozzles

The method of determining defective nozzles in the inkjet recording apparatus 10 according to the present embodiment is described below.

Figure 13:
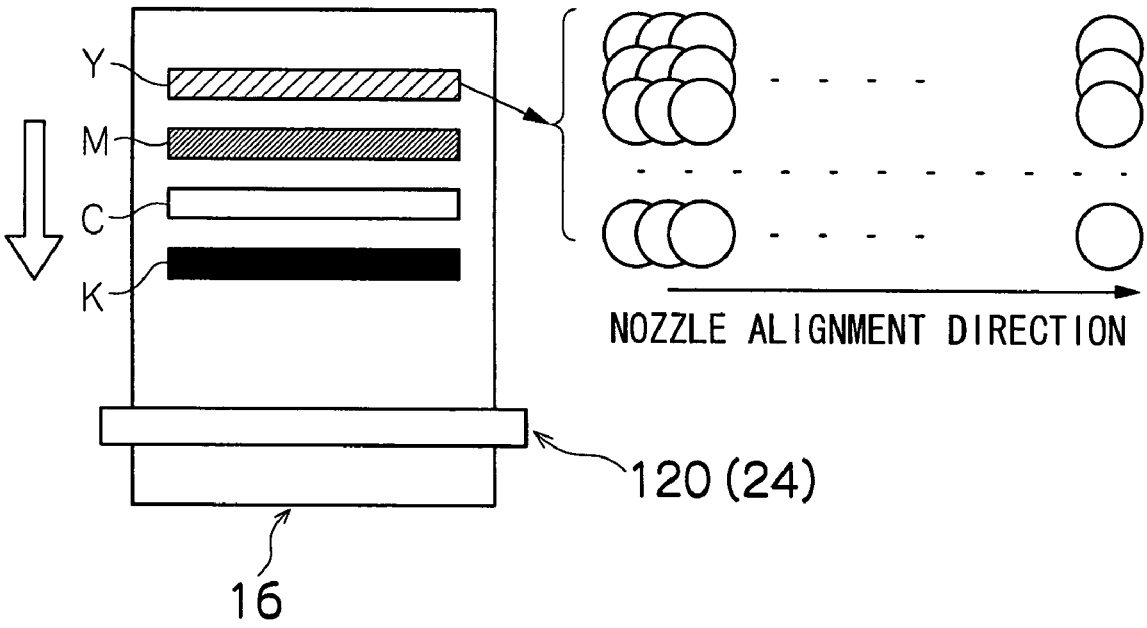
FIG. 13 is a drawing showing an example of a case in which a test pattern is read with the line sensor.

FIG. 13 is a drawing showing an example in which a test pattern is printed on the recording paper 16 and the print result of the test pattern is read with the line sensor 120 in the print determination unit 24. The test pattern is formed by a command to eject a predetermined amount of droplets from all the nozzles of the print heads 12K, 12C, 12M, and 12Y so as to fill in a predetermined print area for each ink color with a single respective color. In other words, "solid printing" is performed for each color in a fixed range in the sub-scanning direction over the entire recordable width.

As shown in FIG. 13, rectangular filled-in patterns (solidly printed patterns for respective colors, with the maximum recordable width) are formed in the order of K, C, M, and Y from the downstream side on the recording paper 16 in accordance with the arrangement order of the print heads 12K, 12C, 12M, and 12Y. The pattern portion for each color is formed by droplets ejected from all the nozzles in the main scanning direction, as shown on the right-hand side of FIG. 13, and a plurality of rows of ejected droplets form a continuous dot pattern in the sub-scanning direction.

This test pattern is read with the line sensor 120 in the print determination unit 24. The start timing for reading with the line sensor 120 is determined according to the distance between the nozzles and the sensors (pixels), and the conveyance velocity of the recording paper 16.

Figure 14:
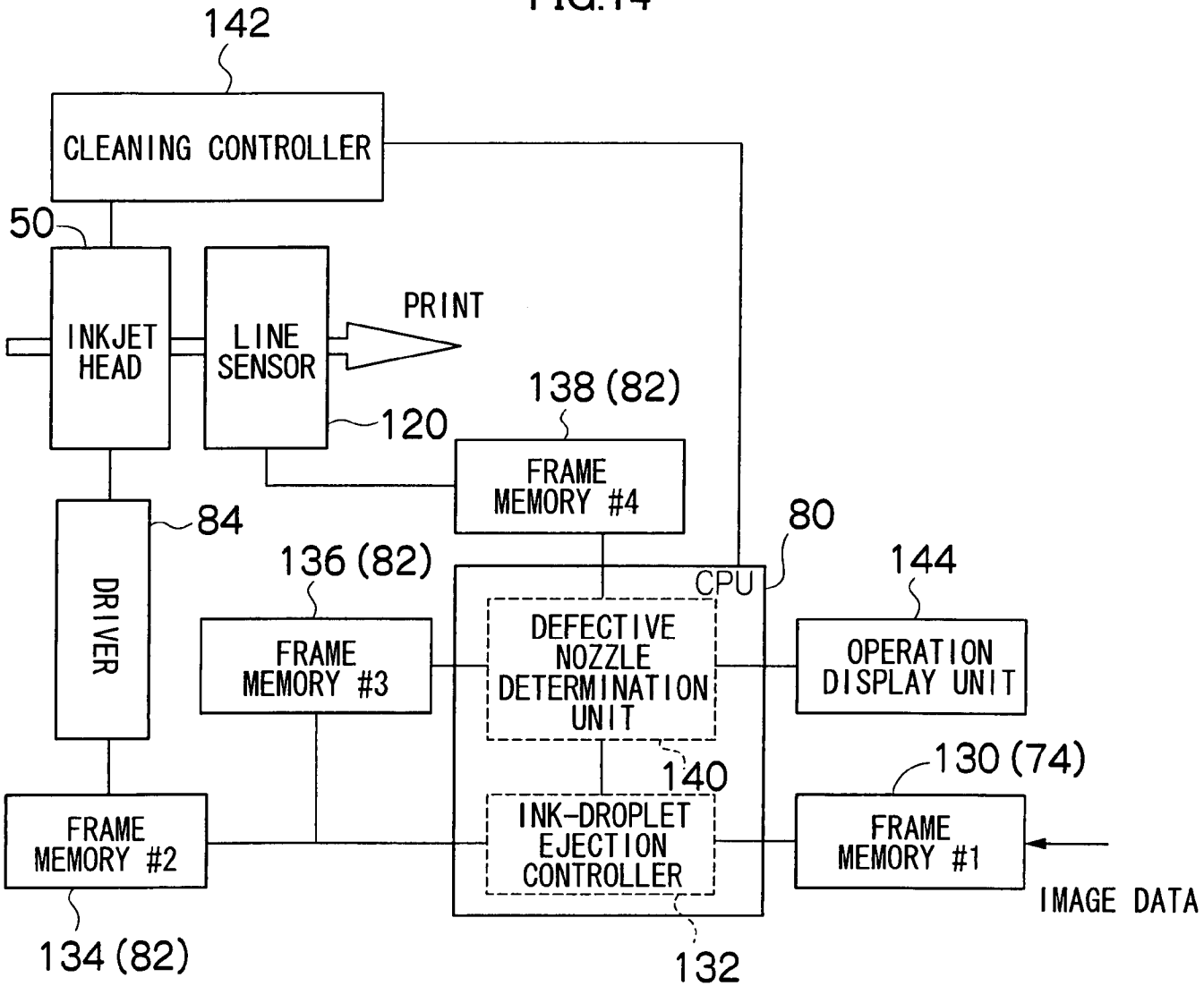
FIG. 14 is a block diagram showing configuration of principal components for defective nozzle determination in the inkjet recording apparatus.
Figure 20:
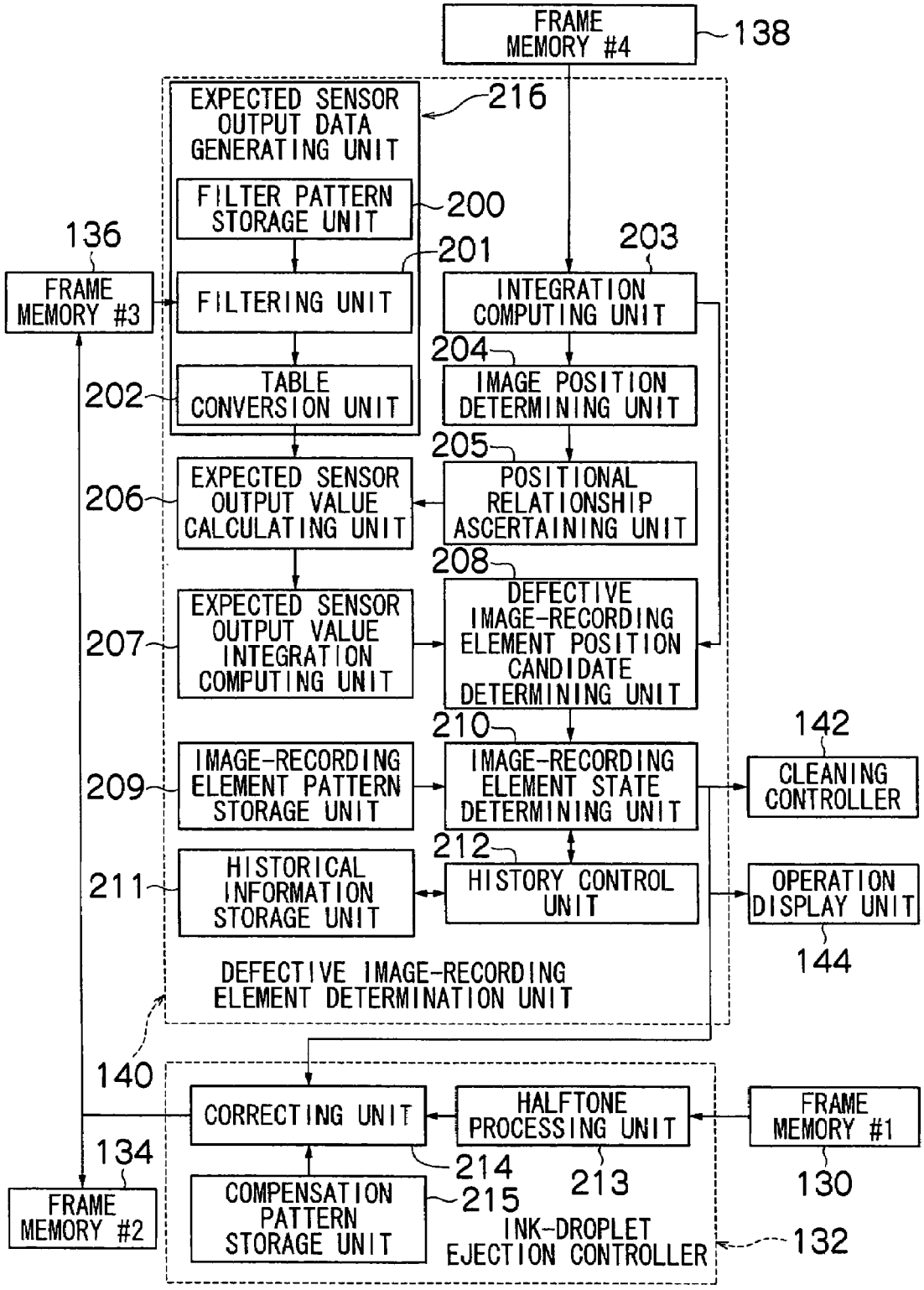
FIG. 20 is a block diagram showing the detailed configuration of a defective nozzle determination unit (a defective image-recording element determining device) and an ink-droplet ejection controller in FIG. 14.

FIG. 14 is a block diagram showing the configuration of the principal components for defective nozzle determination in the inkjet recording apparatus 10, where the same reference numerals or the parenthetical reference numerals are assigned to the portions corresponding to those described in the block diagram shown in FIG. 7. FIG. 20 is a block diagram showing the detailed configuration of a defective nozzle determination unit (a defective image-recording element determining device) 140 and an ink-droplet ejection controller 132 shown in FIG. 14.

The image data to be printed is externally inputted through the communication interface 70 described in FIG. 7, and is stored in a first frame memory 130 shown in FIG. 14. In this stage, the RGB image data is stored in the first frame memory 130.

The image data stored in the first frame memory 130 is sent to the ink-droplet ejection controller 132 and converted to the dot data for each color by a known random dithering algorithm or another technique in a halftone processing unit 213 in the ink-droplet ejection controller 132. In other words, the ink-droplet ejection controller 132 performs a processing for converting the inputted RGB image data to the dot data for the four colors of KCMY. The dot data generated by the ink-droplet ejection controller 132 is stored in a second frame memory 134. At the same time, a portion of the dot data used for determining and compensating defective nozzles is stored in a third frame memory 136.

The head driver 84 acquires the dot data stored in the second frame memory 134, generates drive control signals for the print head 50 according to the acquired dot data, and applies the drive control signals to the print head 50. The print head 50 ejects ink-droplets according to the drive control signals applied from the head driver 84. An image is formed on the recording paper 16 by controlling the ink-droplet ejection from the print head 50 in synchronization with the conveyance velocity of the recording paper 16.

After ink-droplets are ejected through the action of the print head 50, a droplet deposition image, which is produced by the dots formed from the ejected ink-droplets deposited on the recording paper 16, is read with the line sensor 120. The data outputted from the line sensor 120 is stored in a fourth frame memory 138. The defective nozzle determination unit 140 performs five Steps 1 to 5 and history control as described later on the basis of the data stored in the fourth frame memory 138 and the data stored in the third frame memory 136. Since the actual compensation operation is performed by the ink-droplet ejection controller 132, the defective nozzle determination unit 140 only provides compensation commands to the ink-droplet ejection controller 132.

When the cleaning operation is performed according to the results of the defective nozzle determination processing performed by the defective nozzle determination unit 140, commands are sent from the print controller 80 to a cleaning controller 142. The cleaning controller 142 controls, in accordance with the commands from the print controller 80, the cleaning operations (nozzle restoration operations) brought about by a preparatory ejection, a suction action with the suction pump 67, a wiping action with the cleaning blade 66, or an appropriate combination thereof, as described above with reference to FIG. 6.

When a warning display or the like is generated to report the presence of a defective nozzle, a command is sent to an operation display unit 144, and the operation display unit 144 displays predetermined warning information in accordance with this command.

The processing for determining and compensating defective nozzles in the defective nozzle determination unit 140 includes Steps 1 to 5 described below, and history control based on the compensation results thereof.

Step 1: Generating Data Showing Expected Sensor Output Values for One Line from the Dot Data First, as Step 1, data showing expected sensor output values to be obtained at the center positions of the nozzles for one line (predicted values indicating what the sensor output values at the nozzle positions should be) is generated from the data of the ink-droplet ejection command. This is a step of generating data, according to the existing ink-droplet ejection command data (the dot data), for estimating the expected values that indicate what the sensor output values will be when ink-droplet ejection is accurately performed in accordance with the ink-droplet ejection command. The Step 1 is performed by an expected sensor output data generating unit 216 in FIG. 20. Specifically, the processing of Steps 1-1 and 1-2 described below is performed.

Step 1-1: Filtering Processing

Figures 15, 16:
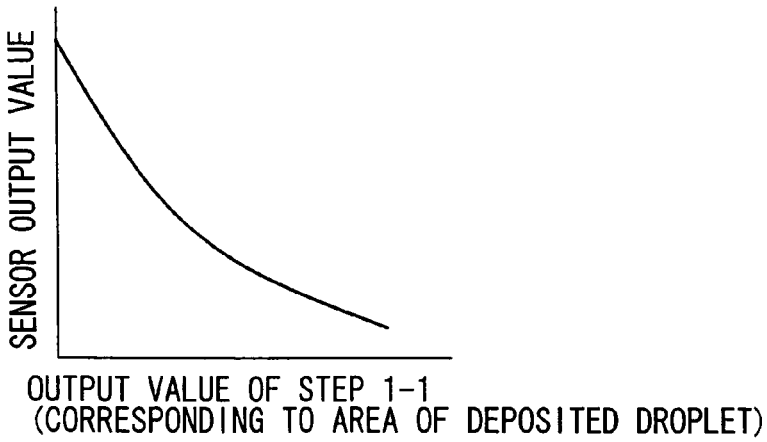
FIG. 15 is a drawing showing an example of a filter used in a filtering processing.
FIG. 16 is a graph exemplifying a conversion table used when converting output values of the filtering processing to sensor output values.

A filtering processing is performed using a filter such as that shown in FIG. 15 with respect to the ink-droplet deposition pattern including a dot deposited by the target nozzle in the center of the filter and surrounding dots within the read range of the sensor (of a pixel). Exemplified in FIG. 15 is a filter in which a 5×5 pixel range in the nozzle alignment direction and the paper conveyance direction is to be computed. Each coefficient in the filter is determined according to the area of each dot included in the sensor read range. In other words, the area contribution ratio (coefficient) of the dot deposited by the target nozzle in the center of the filter is the highest, and the area contribution ratios (coefficients) of the surrounding dots decrease approaching the left, right, top, and bottom ends of the filter.

These data are stored in a filter pattern storage unit 200 in FIG. 20, and the filtering processing is performed by a filtering unit 201.

The three coefficients in each cell of the filter in FIG. 15 show that one of the three coefficients is selected in accordance with the corresponding ejected droplet size (the dot size) when the droplet size is controlled among from the following three types: no droplet, a small-sized droplet, and a large-sized droplet. The ejected droplet size can be controlled by varying the waveform of the drive pulse applied to the actuator. This aspect in which the filter coefficient is selected in accordance with the ejected droplet size is particularly effective when processing an actual print job.

The data obtained from the results of the above filtering processing constitute values that reflect the real areas of the dots (the areas of the deposited droplets) formed on the recording paper 16 by the ink-droplets ejected from the nozzles.

Step 1-2: Conversion to the Expected Sensor Output Values

Next, a conversion procedure is performed for transforming the values obtained after the filtering processing in the Step 1-1 to the expected sensor output values. A photoelectric transducing sensor such as a CCD outputs a linear signal output value that corresponds to the receiving luminous energy (when a gamma correction is made, a certain value obtained by multiplication with the gamma coefficient can be obtained). Therefore, the conversion must be performed with a conversion look-up-table (LUT) as to what sensor output values are expected to be obtained with respect to the actual areas of the deposited droplets. The conversion processing is performed by a table conversion unit 202 in FIG. 20. The conversion LUT used in the conversion processing is experimentally determined.

In other words, ink-droplet ejection is performed several times in advance, the resulting dots are read with the sensors, and the conversion LUT is determined based on experimental results that indicate what sensor output values have been obtained. For example, a conversion table for which the relationship in the graph in FIG. 16 is reflected is provided, and the output values of the Step 1-1 are converted to the expected sensor output values in accordance with the conversion table.

The processing of the Steps 1-1 and 1-2 is performed with respect to dots deposited by all of the nozzles of each of the print heads, and the expected sensor output values corresponding to the center positions of the nozzles for one line are thus obtained.

Step 2: Position Correction of the Sensor Output Data

It is assumed that a positional displacement of the line sensor 120 and the nozzle row of up to about 100μm can be present in each of the nozzle alignment direction and the paper conveyance direction. Step 2 is for correcting the displacement in the nozzle alignment direction. Normally, the line sensor is disposed comparatively near the head, so that the relative positional relationship between the pixels (sensors) and the nozzles is substantially constant during a period of a single read. Hence, a fixed correction is performed over a read period. Specifically, the processing of Steps 2-1 to 2-4 described below is performed.

Step 2-1: Reading the Image

First, the image is read in a unit that is not shorter than a fixed length in the sub-scanning direction (the paper conveyance direction). If the image (i.e., the dots) is read in a single-line unit, then the accuracy of position determination will be reduced by reading errors, noises, and other effects. Hence, the inkjet recording apparatus 10 of the present embodiment reads the image through a predetermined unit of minimum constant length (a unit of a plurality of lines) in the paper conveyance direction, and the droplet deposition image data is integrated (averaged) along the paper conveyance direction by an integration by an integration computing unit 203 in FIG. 20.

Step 2-2: Determining Both Edge Positions of the Image

Next, both edge positions of the image are determined by an image position determining unit 204. In other words, the edge profiles in the vicinity of both edges of the image of the integral data obtained in the Step 2-1 are compared, and processing is performed to determine the edge positions corresponding to the edges of the image. Specifically, the position at which the difference of pair of neighboring pixels in output values is at a maximum is obtained, and this position is determined to be the edge of the image and is associated with the nozzle position (number). The reason for using the difference of the pair of neighboring pixels is that the effect of errors is less than in the case in which absolute values are used. The range of comparison is held to about two to three times the assumed amount of positional displacement of the line sensor 120 and the nozzle row in order to avoid a large error (judgment error).

Figure 17:
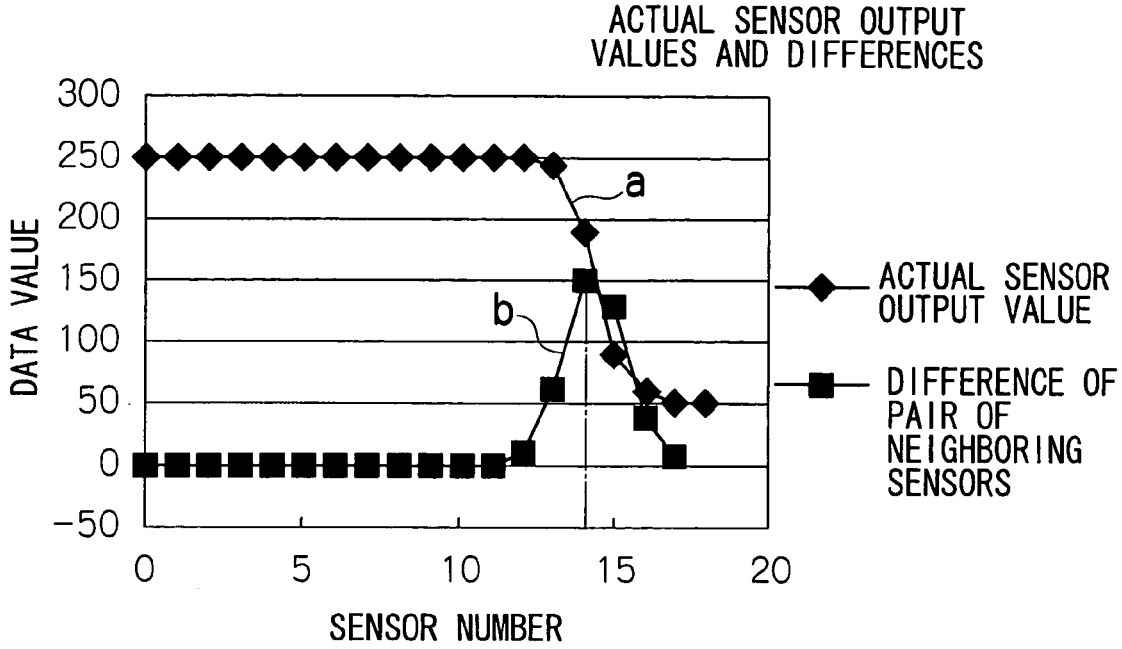
FIG. 17 is a graph showing actual sensor output values in the vicinity of the left-hand side edge portion of an image, and differences of pairs of neighboring sensors (pixels) in the output values.

FIG. 17 is a graph showing the actual sensor output values in the vicinity of the left-hand side edge portion of the image, and the differences of pairs of neighboring sensors (pixels) in the output values. In order to show the positions of the photoelectric transducing elements (pixels) in the line sensor 120, sensor numbers are assigned to the pixels in order from the edge of the line sensor 120, and the positions of the pixels are represented by these sensor numbers. The blank portions (areas with no droplet deposited) of the recording paper 16 are bright, and the portions with the image (dots) formed by ink-droplet ejection become dark, so that the sensor outputs corresponding to the blank portions are high and the sensor outputs corresponding to the image portions are low (see the graph a in FIG. 17).

The difference of pair of neighboring pixels with a sensor number k refers to the difference between the output value of the sensor number (k−1) and the output value of the sensor number (k+1). According to the graph b in FIG. 17 showing the differences of pairs of neighboring pixels, the peak of the differences is located at the sensor number "14".

Figure 18:
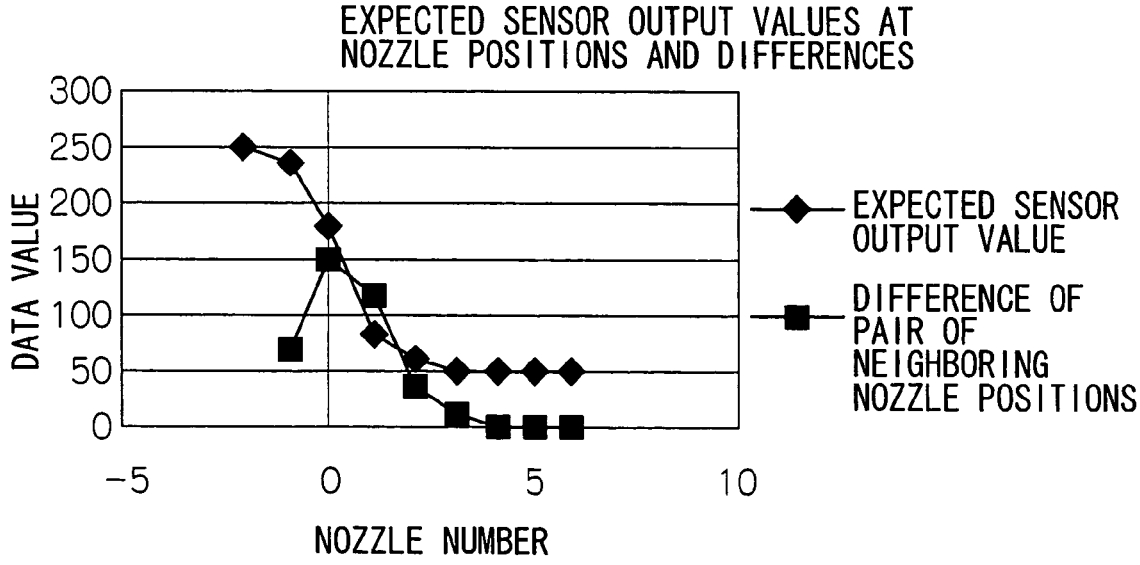
FIG. 18 is a graph showing expected sensor output values at nozzle positions, and differences of pairs of neighboring nozzle positions in the expected sensor output values.

FIG. 18 is a graph showing the expected sensor output values at the nozzle positions, and the differences of pairs of neighboring nozzle positions in the expected sensor output values. The expected sensor output value at each nozzle position is obtained in the Step 1.

In order to show the positions of the nozzles, numbers are assigned to the nozzles in order from the edge of the row of the nozzles in the print head, and the center positions of the nozzles are represented by these nozzle numbers. The actual nozzle numbers start from number "0" of the nozzle on the edge, which serves as a reference, and the reason for assigning negative nozzle numbers in the graph in FIG. 18 is that dots may be formed in positions further outside from the number "0" nozzle, and the detection signal can be obtained from the sensor if the dots in positions outside of the nozzles are within a certain read range of the sensor.

By comparing the graphs shown in FIGS. 17 and 18, the sensor of the number 14, which is the peak of the differences of pairs of neighboring pixels, can be associated with the nozzle number "0". The processing for the left-hand side edge portion of the image has been described in FIGS. 17 and 18, and the same processing is performed for the right-hand side edge portion of the image, and the relationship between the nozzle number and the sensor number is obtained for each edge of the image.

Step 2-3: Determining the Nozzle Position

The nozzle positions are determined by a positional relationship ascertaining unit 205 in FIG. 20. Supposing that the combinations of the sensor numbers and the nozzle numbers on both edges of the image obtained in the Step 2-2 are (SO, NO) and (Sm, Nm), the nozzle position (number) can be expressed by the following equation (1) when the position of the i-th sensor is converted to the nozzle position (number) Pi.

$$Pi=(Nm-NO)/(Sm-SO)\times(i-SO)+NO \quad (1)$$

Step 2-4: Calculating the Expected Output Value at the Sensor Position

By an expected sensor output value calculating unit 206 in FIG. 20, the weighted average (weighted with the reciprocal of the distance) is calculated with the expected output values of the pair of neighboring nozzle numbers of the nozzle position Pi obtained from the equation (1), and the expected output value Ei for the i-th sensor is obtained.

Step 3: Rough Determination of Defective Nozzles

First, the actual output value Di of the i-th sensor and the expected output value Ei of the i-th sensor obtained in the Step 2 are used to roughly determine defective nozzles. Here, the reason for not converting Di to nozzle position data is to avoid reducing the resolution of the high-frequency defective data with interpolation operations. Specifically, the processing of Steps 3-1 to 3-3 described below is performed.

Step 3-1: Integration of Data Values Along the Paper Conveyance Direction

According to a single line of data, it is difficult to accurately determine which nozzles have ejected droplets to form the single line, so that the i-th sensor data values are first integrated (averaged) along the paper conveyance direction. Thus, noise and other reading errors are also averaged, and the small changes in the data values produced by the deficiency of the nozzles are made determinable. If the data is obtained from a solid image such as the test pattern described in FIG. 13, a displacement in the paper conveyance direction is rarely a problem as long as the read position does not deviate from the solid range. The actual sensor output values are integrated by the integration computing unit 203 in FIG. 20, and the expected sensor output values are integrated by an expected sensor output value integration computing unit 207.

When using an actual print job, the image data is not constant, so that the data is integrated for a greater length (longer than when using a test pattern) along the paper conveyance direction. By integrating the data over a greater length, the frequency of the image data along the nozzle alignment direction is lowered, and the frequency of the data variations due to defective nozzles is thus raised relatively to the frequency of the image data, so that the data variations due to defective nozzles can be more easily detected.

Thus, the obtained integral value of the i-th actual sensor output value Di is set as Dsi, and the obtained integral value of the i-th expected sensor output value Ei is set as Esi.

Step 3-2: Selecting Defective Nozzle Candidates

Next, a defective nozzle candidate is selected by a defective image-recording element position candidate determining unit 208 in FIG. 20. The difference ΔDsi (normalized difference) in the integrated actual sensor output values and the difference ΔEsi (normalized difference) in the integrated expected sensor output values are obtained for a pair of adjacent sensors (i-th and (i−1)-th) in accordance with the following equations (2) and (3), respectively, and these differences ΔDsi and ΔEsi are compared to each other.

$$\Delta Dsi=(Dsi-Ds(i-1))/(Dsi+Ds(i-1)) \quad (2)$$

$$\Delta Esi=(Esi-Es(i-1))/(Esi+Es(i-1)) \quad (3)$$

If the difference between the difference ΔDsi and the difference ΔEsi exceeds a predetermined threshold, the number i thereof is registered as a defective nozzle candidate in which a defective nozzle is present in the vicinity. The threshold serving as the determination standard at this time may be experimentally predetermined from data obtained by actually reading an ink-droplet ejection pattern of a defective nozzle.

Step 3-3: Unifying Vicinity Data

Since a defect in a certain nozzle affects the output data of a plurality of the sensors in the vicinity of the position corresponding to the defective nozzle, the vicinity ((i+1), (i−1), and the like) of the "i" that is registered as the defective nozzle candidate in the Step 3-2 may also be extracted as defective nozzle candidates; however, these are due to the certain common (single) defective nozzle. Hence, when there are defective nozzle candidates in the vicinity of the "i", they are represented as a whole by the designation "i" in order to avoid redundancy.

Step 4: Determination of Defective Nozzles and Defective Levels

The defective nozzles and defective levels thereof are determined by an image-recording element state determining unit 210 in FIG. 20. In Step 4, processing for determining the actual position of a defective nozzle and the manner in which the nozzle is defective is performed for the defective nozzle candidates determined in the Step 3.

In other words, a defective nozzle is assumed in advance, and a comparison is made with the actual sensor output for each pattern thereof. In the case of a high-density inkjet head, adequate print quality can be obtained even without rigorously compensating defective nozzles. For example, when the ejected droplet size from a certain nozzle is about ¾ of the normal value, blurring or other defects in the print result cannot be observed, and image degradation cannot be perceived even if compensation to cover the ejection defect is not performed. From this viewpoint, compensation processing is performed to several limited patterns in which there may be problems in the print quality.

The following seven patterns are registered in an image-recording element pattern storage unit 209 in FIG. 20:

(i) Dead nozzle (no ejection) (as exemplified in FIG. 9)

(ii) ½ amount of ejection with no displacement in the droplet deposition position (iii) Positional displacement by one nozzle to the right-hand side (as exemplified by the solid circle in FIG. 12)

(iv) Positional displacement by one nozzle to the left-hand side (reflection symmetry with the solid circle in FIG. 12)

(v) Positional displacement by one nozzle to the right-hand side and ½ amount of ejection (as exemplified by the dashed circle in FIG. 12)

(vi) Positional displacement by one nozzle to the left-hand side and ½ amount of ejection (reflection symmetry with the dashed circle in FIG. 12)

(vii) No deficiency

The operations in Steps 4-1 and 4-2 described below are run through a loop in accordance with the above patterns (i) to (vii) for the nozzles in the vicinity of Pi, and the pattern that best matches the evaluation value is picked up as a combination of the defective nozzle number and the pattern.

Step 4-1: Obtaining the Expected Sensor Output Value

With respect to a nozzle row configuration containing an assumed defective nozzle, the expected sensor output value at the nozzle position is obtained. In other words, the operation described in the Step 1 is calculated as one in which there is deficiency in each of the above patterns. For example, the change in the amount of ejection (volume of liquid ejected) is calculated while changing the coefficients so that a change with a power of about ⅔ takes place when converting to the dot surface area (cross-sectional area).

Thus, supposing that a defective nozzle is present in a certain position and condition, the expected sensor output value is calculated once again in accordance with the computational procedure of the Step 1.

Thereafter, position matching with the sensor and integration along the paper conveyance direction are performed in the same manner to obtain a new Esi.

Step 4-2: Calculation of the Evaluation Value

According to the Esi of the expected sensor output values obtained in the Step 4-1, the evaluation value is calculated as the absolute value in the following equation along the width of the pattern in the vicinity of the position occupied by the defective nozzle candidate.

$$\text{Evaluation value} = \left|\sum^{j} \{(Dsj - Esj) - (Dsi - Esi)\}\right| \quad (4)$$

This evaluation value is found by calculating the absolute value of the relative differences along the width of the pattern, with the absolute value reference being the position of the "i". In accordance with the examples described in FIGS. 9 and 12, the "width of pattern" refers to seven points (or five points) on the vicinity including the center position, and these seven points (or five points) correspond to j.

Thus, in accordance with the equation (4), "number of patterns (seven)×number of nozzle positions (five as a size of the filter)" results in the calculation of a total of 35 evaluation values, and one showing a minimal value is selected from among these as a match.

The defective nozzle position and its deficiency level (condition in any of the patterns (i) to (vii)) are determined by the processing in the Step 4-2.

Step 5: Compensation or Cleaning

Compensation control is performed by a correcting unit 214 in FIG. 20 as required on the basis of the results of the determination of defective nozzles and the determination of level of deficiency in the Step 4. Compensation is performed by changing the amount or frequency of ink-droplet ejection from the nozzles adjacent to the defective nozzle. Specifically, the respective compensation methods for patterns (i) to (vii) are registered in a compensation pattern storage unit 215 in FIG. 20. The contents of the compensation processing associated with the patterns are as follows.

(i) In the case of a dead nozzle (no ejection), control is performed to add ½ of the amount of ejection of the dead nozzle to the amount of ejection of each of the two nozzles on both neighboring sides when a droplet is to be ejected by the dead nozzle. If the amount of ejection cannot be added (the maximum ink-droplet ejection amount is commanded, or other cases), the error thereof is carried over in the paper conveyance direction, and the compensation is made at the subsequent ejection opportunity.

(ii) In the case of a defective nozzle with ½ amount of ejection, control is performed to add ¼ of the amount of ejection of the defective nozzle to the amount of ejection of each of the two nozzles on both neighboring sides when a droplet is to be ejected by the defective nozzle. If the amount of ejection cannot be added, the error thereof is carried over in the paper conveyance direction, and the compensation is made at the subsequent ejection opportunity.

(iii) A defective nozzle that causes a positional displacement by one nozzle to the right-hand side is not compensated. This is because the displacement cannot be visually confirmed in the case of a high-density head.

(iv) A defective nozzle that causes a positional displacement by one nozzle to the left-hand side is not compensated, in the same manner as in (iii).

(v) In the case of a defective nozzle that causes a positional displacement by one nozzle to the right-hand side and in which the ink-droplet ejection amount is ½, control is performed to add ½ of the amount of ejection of the defective nozzle to the amount of ejection of the neighboring nozzle on the left-hand side of the defective nozzle when a droplet is to be ejected by the defective nozzle. In the case that the adding is not possible, the error is carried over in the paper conveyance direction, and the compensation is made at the subsequent ejection opportunity.

(vi) In the case of a defective nozzle that causes a positional displacement by one nozzle to the left-hand side and in which the ink-droplet ejection amount is ½, control is performed to add ½ of the amount of ejection of the defective nozzle to the amount of ejection of the neighboring nozzle on the right-hand side of the defective nozzle when a droplet is to be ejected by the defective nozzle. In the case that the adding is not possible, the error is carried over in the paper conveyance direction, and the compensation is made at the subsequent ejection opportunity.

(vii) It is apparent that compensation is not performed when there is no defective nozzle.

Also possible is an aspect in which the ink suction and wiping of the affected portion are performed without the above compensation action if the sequence allows cleaning (nozzle function restoration action) to be performed when the presence of a defective nozzle has been determined. This operation is directed by the cleaning controller 142 in FIG. 20.

In the above description, cases have been described where the number of nozzles is equal to the number of the sensors as shown in FIG. 9. When implementing the present invention in cases where the number of nozzles is different than the number of the sensors, the same technique as described above may fundamentally be applied to by modifying the filter for filter processing in the Step 2.

In the above description, cases have been described where the cleaning operation is controlled in accordance with the results determined by the image-recording element state determining unit 210 in FIG. 20. Also possible is an aspect in which the cleaning operation is controlled in accordance with the results determined by the defective image-recording element position candidate determining unit 208 in FIG. 20.

Description of History Control

In accordance with the Steps 1 to 5, it is possible to determine defective nozzles with relatively high accuracy; however, there is a fixed limit to the determination accuracy for blurring even if the data is integrated along the paper conveyance direction or otherwise manipulated, and the possibility of incorrect determination and compensation of defective nozzles cannot be entirely eliminated. Cases are also possible in which blurring occurs as a slight line with a density of 0.01 or less, and in which errors are generated in the determination of the positional relationships of the sensors and nozzles.

For this reason, historical information regarding the determination and compensation of a defective nozzle performed in the previous cycle is stored, and history control for improving the accuracy of the determination and compensation of a defective nozzle performed in the next cycle is preferably added using the historical information.

Here, the handling of the case in which a neighboring nozzle is mistakenly compensated as a defective nozzle is described as an example of history control.

Figure 19:
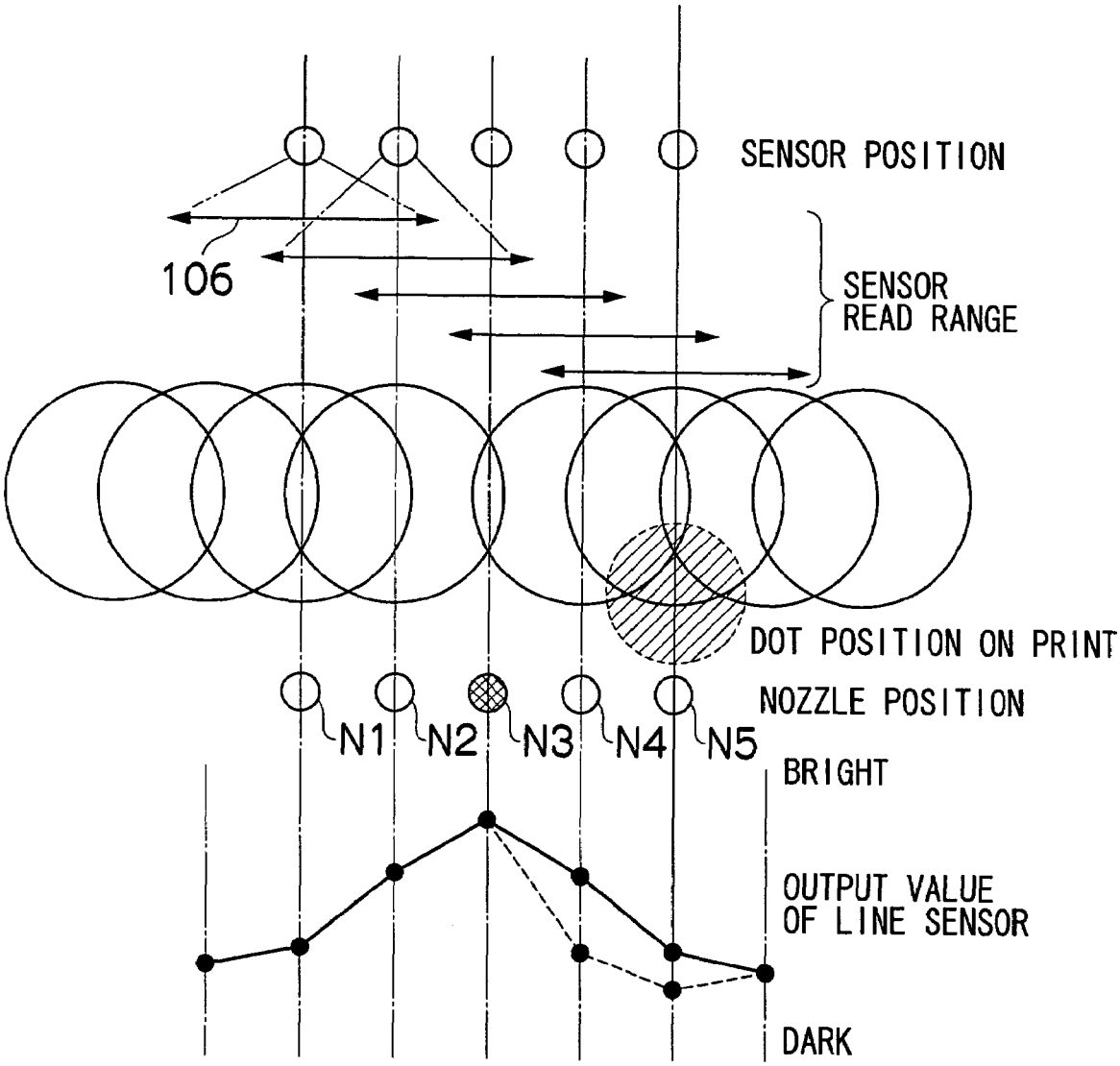
FIG. 19 is a drawing showing an example where defective nozzle determination and compensation have been erroneously performed.

FIG. 19 shows an example where defective nozzle determination and compensation have been erroneously performed. More specifically, in the previous cycle, although a non-ejecting nozzle (dead nozzle) is actually "N3", it has been incorrectly determined as "N4" and a compensation has been made during ink-droplet ejection in the subsequent line. As a result of erroneously concluding the "N4" nozzle to be dead, the amounts of ejection from the two adjacent "N3" and "N5" nozzles are increased by the compensation.

The amount of ejection from the "N5" nozzle is increased as a result of this compensation by a dot amount represented by the dashed circle in FIG. 19. However, since the "N3" nozzle remains incapable of ejection, no droplet is ejected from the "N3" nozzle regardless of an ink-droplet ejection increase command given to the "N3" nozzle by way of compensation.

For this reason, when reading this compensation result, the sensor output values are obtained as represented by the dashed line in FIG. 19. In this case, if defective nozzle determination and compensation processing is performed in the same manner as the previous cycle, then there is a possibility that the "N4" nozzle is concluded to be a dead nozzle again and compensation is not function effectively as a result.

In order to avoid such a situation, historical information is used in the following manner:

(1) The expected sensor output values are calculated without including the amounts of compensation up to the previous cycle, and the Steps 1 to 4 are performed. In this case, the droplet deposition image data with no compensation is stored in the third frame memory 136 in FIG. 20.

(2) At this time, if the same nozzle as the previous cycle is determined as a defective nozzle, one of the neighboring nozzles with the smallest of the evaluation values of the same pattern is reselected as a defective nozzle. (2') Alternatively, instead of (2), if the same nozzle as the previous cycle is determined as a defective nozzle, a combination of a nozzle and a pattern with the second smallest of the evaluation values of the previous cycle is reselected.

In the case that the situation is not improved even after repeating steps (1) and (2) (or (2')), it is possible that a plurality of adjacent nozzles are defective, so that a cleaning operation is performed. Moreover, in the case that the situation is not improved with compensation processing and cleaning operations, a warning is issued. These operations are directed by a history control unit 212 in FIG. 20 with respect to the image-recording element state determining unit 210 in accordance with the previous evaluation value and the determined defective image-recording element information stored in a historical information storage unit 211. The accumulation of historical information is not limited to the previous one cycle, and information from several past cycles including at least the previous cycle may be stored.

Processing Between Colors when Reading the Image of the Actual Print Job

Described above is a case in which an image from a test pattern differentiated by colors as shown in FIG. 8 is read; however, the implementation of the present invention is not limited to the use of a test pattern, and it is possible to use the image of an actual print job.

In the case that the image of an actual print job is used, the same (overlapped) section in which droplets have been deposited by the print heads 12K, 12C, 12M and 12Y for the respective colors is read with line sensors for a plurality of colors (e.g., RGB), and processing is performed in the following ink color order.

(Procedure 1) First, determination of defective nozzles is performed for K ink nozzles. The average values of the outputs from the entire set of RGB sensors are used in the evaluation of the K ink nozzles.

(Procedure 2) Next, determination of defective nozzles is performed for C ink nozzles. Outputs from the R sensors are used in the evaluation of the C ink nozzles. While the defective locations in the K ink nozzles are eliminated, determination and compensation are performed in ranges that exclude these.

(Procedure 3) Next, determination of defective nozzles is performed for M ink nozzles. Outputs from the G sensors are used in the evaluation of the M ink nozzles. While the defective locations in the K ink nozzles and the C ink nozzles are eliminated, determination and compensation are performed in ranges that exclude these.

(Procedure 4) Next, determination of defective nozzles is performed for Y ink nozzles. Outputs from the B sensors are used in the evaluation of the Y ink nozzles. While the defective locations in the K ink nozzles, the C ink nozzles, and the M ink nozzles are eliminated, and determination and compensation are performed in ranges that exclude these.

The reason for processing in the order of K→C→M→Y in accordance with the procedures 1 to 4 is due to the relationship between the spectral sensitivity of the sensors and the optical absorption of the coloring materials in the inks. The K ink gives an output variation that is substantially the same as each of the sensors R, G and B. Therefore, accurate determination of defective K ink nozzles is possible by performing initial processing using the average output values of the sensors R, G and B. The coloring materials normally have sub-absorption on the shorter wavelength side of main-absorption. The C ink has absorption in the R area, and also has absorption on the shorter wavelength side, that is, in the G and B areas. In other words, the C ink affects the determination of the M ink and the Y ink. In a similar fashion, the M ink affects the determination of the Y ink. It is therefore preferable to perform processing in the order of the respective colors having wider range of effects (in other words, in order from the longer wavelength side) in order to eliminate such effects. In this fashion, processing between colors can be efficiently performed.

In the embodiments described above, an inkjet recording apparatus has been described as an example of an image recording apparatus; however, the range of applicability of the present invention is not limited to this. Other than the inkjet recording apparatus, the present invention may also be applied to thermal transfer recording apparatuses with a line head, LED electrophotographic printers, silver halide photographic printers with an LED line exposure head, and other types of image recording apparatuses.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image recording apparatus, comprising:

a printing device which includes a full-line recording head having a plurality of image-recording elements arranged along a length corresponding to an entire width of a printing medium, the recording head recording an image on the printing medium by the plurality of image-recording elements;

a conveying device which moves at least one of the recording head and the printing medium relative to each other in a conveyance direction different than a width direction of the printing medium;

an image reading device which includes a plurality of sensors outputting actual sensor output data by reading the image recorded on the printing medium, the plurality of sensors being arranged along the length corresponding to the entire width of the printing medium; and a defective image-recording element determining device which determines a defective one of the plurality of image-recording elements by performing computation for each sensor of the plurality of sensors according to the actual sensor output data obtained from the each sensor, the actual sensor output data obtained from one of the plurality of sensors adjacent to the each sensor, and expected sensor output data expected from the image to be normally recorded, wherein a pattern of the actual sensor output data obtained from the each sensor and the plurality of sensors adjacent to the each sensor and a pattern of the expected sensor output data are compared, wherein the actual sensor output data obtained from one of the plurality of adjacent sensors represent adjacent areas on the printing medium and where such adjacent area data is used to determine the defect.

2. The image recording apparatus as defined in claim 1, wherein the defective image-recording element determining device performs computation comparing actual data based on the actual sensor output data and the expected sensor output data.

3. The image recording apparatus as defined in claim 1, further comprising an image-recording element state determining device which determines a state of the defective one of the plurality of image-recording elements by comparing an expected sensor output data expected from a recording image when there is a defective image-recording element in a supposed defective state, with the actual sensor output data obtained from the plurality of sensors.

4. The image recording apparatus as defined in claim 1, further comprising at least one of:

a correcting device which corrects an image recording operation according to a result of determination of a defective image-recording element by the defective image-recording element determining device; and a cleaning device which cleans the recording head according to the result of determination of a defective image-recording element by the defective image-recording element determining device.

5. The image recording apparatus as defined in claim 1, further comprising:

a correcting device which performs correction of an image recording operation according to a result of determination of a defective image-recording element by the defective image-recording element determining device;

a historical information storage device which stores at least a previous pair of information of the determination of the defective image-recording element and information of the correction of the image recording operation; and a history control device which determines a content of subsequent correction according to the previous pair of information stored in the historical information storage device and information obtained by reading the image after the correction with the image reading device.

6. The image recording apparatus as defined in claim 1, wherein:

the recording head is adapted to record the image in at least colors of cyan (C), magenta (M), and yellow (Y);

the image reading device comprises an RGB sensor row adapted to resolve and read red (R) light, green (G) light, and blue (B) light;

the RGB sensor row reads an image section where the colors are recorded in an overlaid fashion by the printing device;

defective image-recording element determining processing is performed in order of the colors of C, M, and Y; and the defective image-recording element determining processing for a subsequent color is performed while removing a location determined to be the defective image-recording element in the defective image-recording element determining processing for a previous color.

7. The image recording apparatus as defined in claim 1, wherein:

the recording head is adapted to record the image in at least colors of black (K), cyan (C), magenta (M), and yellow (Y);

the image reading device comprises an RGB sensor row adapted to resolve and read red (R) light, green (G) light, and blue (B) light;

the RGB sensor reads an image section where the colors are recorded in an overlaid fashion by the printing device;

defective image-recording element determining processing is performed in order of the colors of K, C, M, and Y; and s while removing a location determined to be the defective image-recording element in the defective image-recording element determining processing for a previous color.

8. The image recording apparatus as defined in claim 1, wherein the defective image-recording element determining device determines the defective one of the plurality of image-recording elements and condition of the defective one of the plurality of image-recording elements by performing computation of change in the actual sensor output data obtained from at least one of the plurality of sensors adjacent to the each sensor according to the actual sensor output data obtained from the each sensor, the actual sensor output data obtained from the at least one of the plurality of sensors adjacent to the each sensor, and the expected sensor output data expected from the image to be normally recorded.

9. The image recording apparatus as defined in claim 1, wherein the plurality of sensors respectively have read ranges which each correspond to a range of three dots arranged consecutively in the width direction on the printing medium and which overlap with each other between adjacent sensors of the plurality of sensors.

10. The image recording apparatus as defined in claim 1, further comprising:

an expected read data generation device which generates expected read data indicating predicted values of the actual sensor output data corresponding to positions of the respective image-recording elements according to dot data which is generated from data of the image to be recorded by means of a halftone processing;

an integration computing device which computes integrated data obtained by integrating the actual sensor output data in the conveyance direction through a unit having a length in the conveyance direction not shorter than a predetermined length;

an image position determining device which determines two locations corresponding to both edge positions of the image according to differential between the adjacent sensors in a main scanning direction substantially perpendicular to the conveyance direction based on the integrated data obtained by the integration computing device, and which determines a positional relationship of the expected sensor output data and positions of the sensors corresponding to the two locations;

a positional relationship ascertaining device which ascertains a relationship between positions of the plurality of sensors and positions of the plurality of image-recording elements by associating the positions of the plurality of sensors corresponding to the two locations determined by the image position determining device and the positions of the plurality of image-recording elements; and an expected sensor output value calculating device which obtains the expected sensor output data of the positions of the plurality of sensors by interpolation computation according to the relationship between the positions of the plurality of sensors and the positions of the plurality of image-recording elements ascertained by the positional relationship ascertaining device.

11. An image recording apparatus, comprising:

a printing device which includes a full-line recording head having a plurality of image-recording elements arranged along a length corresponding to an entire width of a printing medium, the recording head recording an image on the printing medium by the plurality of image-recording elements;

a conveying device which moves at least one of the recording head and the printing medium relative to each other in a conveyance direction different than a width direction of the printing medium;

an image reading device which includes a plurality of sensors outputting actual sensor output data by reading the image recorded on the printing medium, the plurality of sensors being arranged along the length corresponding to the entire width of the printing medium;

a defective image-recording element determining device which determines a defective one of the plurality of image-recording elements by performing computation for each sensor of the plurality of sensors according to the actual sensor output data obtained from the each sensor, the actual sensor output data obtained from one of the plurality of sensors adjacent to the each sensor, and expected sensor output data expected from the image to be normally recorded, wherein the actual sensor output data obtained from one of the plurality of adjacent sensors represent adjacent areas on the printing medium and where such adjacent area data is used to determine the defect; and an expected sensor output data generating device which generates the expected sensor output data according to dot data generated from data of the image to be recorded, the expected sensor output data generating device including a filtering device which filters the dot data, wherein the filtering device filters the dot data using a filter having a plurality of types of filter coefficients corresponding to a plurality of types of dot sizes, one of the plurality of types of filter coefficients being selected according to the dot size represented by the dot data.

12. An image recording apparatus, comprising:

a printing device which includes a full-line recording head having a plurality of image-recording elements arranged along a length corresponding to an entire width of a printing medium, the recording head recording an image on the printing medium by the plurality of image-recording elements;

a conveying device which moves at least one of the recording head and the printing medium relative to each other in a conveyance direction different than a width direction of the printing medium;

an image reading device which includes a plurality of sensors outputting actual sensor output data by reading the image recorded on the printing medium, the plurality of sensors being arranged along the length corresponding to the entire width of the printing medium;

a defective image-recording element determining device which determines a defective one of the plurality of image-recording elements by performing computation for each sensor of the plurality of sensors according to the actual sensor output data obtained from the each sensor, the actual sensor output data obtained from one of the plurality of sensors adjacent to the each sensor, and expected sensor output data expected from the image to be normally recorded, wherein the actual sensor output data obtained from one of the plurality of adjacent sensors represent adjacent areas on the printing medium and where such adjacent area data is used to determine the defect;

an integration computing device which computes integrated data obtained by integrating the actual sensor output data along the conveyance direction through a unit having a length in the conveyance direction not shorter than a predetermined length;

an image position determining device which determines a positional relationship of the expected sensor output data and positions of the plurality of sensors corresponding to at least two locations in a main scanning direction substantially perpendicular to the conveyance direction by comparing, according to the integrated data obtained by the integration computing device, image characteristics values around the at least two locations with image characteristics values of integrated data of the expected sensor output data;

a positional relationship ascertaining device which ascertains relationship between positions of the plurality of sensors and positions of the plurality of image-recording elements by associating the positions of the plurality of sensors corresponding to the at least two locations determined by the image position determining device and the positions of the plurality of image-recording elements; and an expected sensor output value calculating device which obtains expected sensor output values for the positions of the plurality of sensors by interpolation computation according to the relationship between the positions of the plurality of sensors and the positions of the plurality of image-recording elements ascertained by the positional relationship ascertaining device.

13. The image recording apparatus as defined in claim 12, further comprising a defective image-recording element position candidate determining device which determines an approximate position of the defective one of the plurality of image-recording elements in accordance with an integral value obtained by integrating the actual sensor output data obtained from the plurality of sensors along the conveyance direction and with an integral value obtained by integrating the expected sensor output values obtained by the expected sensor output value calculating device along the conveyance direction.

14. The image recording apparatus as defined in claim 13, further comprising a cleaning device which cleans the recording head according to a result of determination of an approximate position of the defective one of the plurality of image-recording elements by the defective image-recording element position candidate determining device.

15. A method for determining a defective image-recording element in an image recording apparatus, comprising:

recording an image on a printing medium by a full-line recording head having a plurality of image-recording elements arranged along a length corresponding to an entire width of the printing medium;

reading the image recorded on the printing medium by a reading device including a plurality of sensors outputting actual sensor output data, the plurality of sensors being arranged along the length corresponding to the entire width of the printing medium; and determining a defective one of the plurality of image-recording elements by performing computation for each sensor of the plurality of sensors according to the actual sensor output data obtained from the each sensor, the actual sensor output data obtained from one of the plurality of sensors adjacent to the each sensor, and expected sensor output data expected from the image to be normally recorded, wherein a pattern of the actual sensor output data obtained from the each sensor and the plurality of sensors adjacent to the each sensor and a pattern of the expected sensor output data are compared, wherein the actual sensor output data obtained from one of the plurality of adjacent sensors represent adjacent areas on the printing medium and where such adjacent area data is used to determine the defect.

16. The method as defined in claim 15, wherein the determining the defective one of the plurality of image-recording elements comprises performing computation comparing actual data based on the actual sensor output data and the expected sensor output data.

17. The method as defined in claim 15, further comprising determining a state of the defective one of the plurality of image-recording elements by comparing an expected sensor output data expected from a recording image when there is a defective image-recording element in a supposed defective state, with the actual sensor output data obtained from the plurality of sensors.

18. The method as defined in claim 15, further comprising at least one of:

correcting an image recording operation according to a result of determination of a defective image-recording element by the defective image-recording element determining; and cleaning the recording head according to the result of determination of a defective image-recording element by the defective image-recording element determining.

19. The method as defined in claim 15, further comprising:

performing correction of an image recording operation according to a result of determination of a defective image-recording element by the defective image-recording element determining;

storing at least a previous pair of information of the determination of the defective image-recording element and information of the correction of the image recording operation; and determining a content of subsequent correction according to the previous pair of information stored and information obtained by reading the image after the correction with the image reading.

20. A method for determining a defective image-recording element in an image recording apparatus; comprising:

recording an image on a printing medium by a full-line recording head having a plurality of image-recording elements arranged along a length corresponding to an entire width of the printing medium;

reading the image recorded on the printing medium by a reading device including a plurality of sensors outputting actual sensor output data, the plurality of sensors being arranged along the length corresponding to the entire width of the printing medium;

determining a defective one of the plurality of image-recording elements by performing computation for each sensor of the plurality of sensors according to the actual sensor output data obtained from the each sensor, the actual sensor output data obtained from one of the plurality of sensors adjacent to the each sensor, and expected sensor output data expected from the image to be normally recorded, wherein the actual sensor output data obtained from one of the plurality of adjacent sensors represent adjacent areas on the printing medium and where such adjacent area data is used to determine the defect;

generating the expected sensor output data according to dot data generated from data of the image to be recorded, the generating the expected sensor output data including filtering the dot data, wherein the filtering comprises filtering the dot data using a filter having a plurality of types of filter coefficients corresponding to a plurality of types of dot sizes, one of the plurality of types of filter coefficients being selected according to the dot size represented by the dot data.

21. A method for determining a defective image-recording element in an image recording apparatus, comprising:

recording an image on a printing medium by a full-line recording head having a plurality of image-recording elements arranged along a length corresponding to an entire width of the printing medium;

reading the image recorded on the printing medium by a reading device including a plurality of sensors outputting actual sensor output data, the plurality of sensors being arranged along the length corresponding to the entire width of the printing medium;

determining a defective one of the plurality of image-recording elements by performing computation for each sensor of the plurality of sensors according to the actual sensor output data obtained from the each sensor, the actual sensor output data obtained from one of the plurality of sensors adjacent to the each sensor, and expected sensor output data expected from the image to be normally recorded, wherein the actual sensor output data obtained from one of the plurality of adjacent sensors represent adjacent areas on the printing medium and where such adjacent area data is used to determine the defect;

moving at least one of the recording head and the printing medium relatively to each other in a conveyance direction substantially perpendicular to a width direction of the printing medium;

computing integrated data obtained by integrating the actual sensor output data along the conveyance direction through a unit having a length in the conveyance direction not shorter than a predetermined length;

determining a positional relationship of the expected sensor output data and positions of the plurality of sensors corresponding to at least two locations in a main scanning direction substantially perpendicular to the conveyance direction by comparing, according to the integrated data, image characteristics values around the at least two locations with image characteristics values of integrated data of the expected sensor output data;

ascertaining relationship between positions of the plurality of sensors and positions of the plurality of image-recording elements by associating the positions of the plurality of sensors corresponding to the at least two locations and the positions of the plurality of image-recording elements; and obtaining expected sensor output values for the positions of the plurality of sensors by interpolation computation according to the relationship between the positions of the plurality of sensors and the positions of the plurality of image-recording elements.

22. The method as defined in claim 21, further comprising determining an approximate position of the defective one of the plurality of image-recording elements in accordance with an integral value obtained by integrating the actual sensor output data obtained from the plurality of sensors along the conveyance direction and with an integral value obtained by integrating the expected sensor output values along the conveyance direction.

23. The method as defined in claim 22, further comprising cleaning the recording head according to a result of determination of an approximate position of the defective one of the plurality of image-recording elements by the approximate position of the defective one of the plurality of image-recording elements determining.

24. A method for determining a detective image-recording element in an image recording apparatus, comprising:

recording an image on a printing medium by a full-line recording head having a plurality of image-recording elements arranged along a length corresponding to an entire width of the printing medium;

reading the image recorded on the printing medium by a reading device including a plurality of sensors outputting actual sensor output data, the plurality of sensors being arranged along the length corresponding to the entire width of the printing medium; and determining a defective one of the plurality of image-recording elements by performing computation for each sensor of the plurality of sensors according to the actual sensor output data obtained from the each sensor, the actual sensor output data obtained from one of the plurality of sensors adjacent to the each sensor, and expected sensor output data expected from the image to be normally recorded, wherein the actual sensor output data obtained from one of the plurality of adjacent sensors represent adjacent areas on the printing medium and where such adjacent area data is used to determine the defect, wherein the image recording comprises recording by the recording head adapted to record the image in at least colors of cyan (C), magenta (M), and yellow (Y);

the image reading comprises reading an image section where the colors are recorded in an overlaid fashion by the printing by an RGB sensor row adapted to resolve and read red (R) light, green (G) light, and blue (B) light;

the defective image-recording element determining is performed in order of the colors of C, M, and Y; and the defective image-recording element determining for a subsequent color is performed while removing a location determined to be the defective image-recording element in the defective image-recording element determining for a previous color.

25. A method for determining a defective image-recording element in an image recording apparatus, comprising:

recording an image on a printing medium by a full-line recording head having a plurality of image-recording elements arranged along a length corresponding to an entire width of the printing medium;

reading the image recorded on the printing medium by a reading device including a plurality of sensors outputting actual sensor output data, the plurality of sensors being arranged along the length corresponding to the entire width of the printing medium; and determining a defective one of the plurality of image-recording elements by performing computation for each sensor of the plurality of sensors according to the actual sensor output data obtained from the each sensor, the actual sensor output data obtained from one of the plurality of sensors adjacent to the each sensor, and expected sensor output data expected from the image to be normally recorded, wherein the actual sensor output data obtained from one of the plurality of adjacent sensors represent adjacent areas on the printing medium and where such adjacent area data is used to determine the defect, wherein the image recording comprises recording by the recording head adapted to record the image in at least colors of black (K), cyan (C), magenta (M), and yellow (Y);

the image reading comprises reading an image section where the colors are recorded in an overlaid fashion by the printing by an RGB sensor row adapted to resolve and read red (R) light, green (G) light, and blue (B) light;

the defective image-recording element determining is performed in order of the colors of K, C, M, and Y; and the defective image-recording element determining for a subsequent color is performed while removing a location determined to be the defective image-recording element in the defective image-recording element determining for a previous color.

26. An image recording apparatus, comprising:

a printing device which includes a full-line recording head having a plurality of image-recording elements arranged along a length corresponding to an entire width of a printing medium, the recording head recording an image on the printing medium by the plurality of image-recording elements;

a conveying device which moves at least one of the recording head and the printing medium relative to each other in a conveyance direction different than a width direction of the printing medium;

an image reading device which includes a plurality of sensors outputting actual sensor output data by reading the image recorded on the printing medium, the plurality of sensors being arranged along the length corresponding to the entire width of the printing medium; and a defective image-recording element determining device which determines an approximate position for a defective one of the plurality of image-recording elements according to the actual sensor output data obtained from each of the plurality of sensors of the image reading device and expected sensor output data expected from the image to be normally recorded, and determines a position of the defective one of the plurality of image-recording elements and a defective state of the defective one of the plurality of image-recording elements from among supposed defective states by comparing a pattern of the actual sensor output data obtained from each of the plurality of sensors that are situated in a neighboring region, including positions of the image-recording elements which are situated near the determined approximate position and which are selected as image-recording elements having a possibility of being the defective one of the plurality of image-recording elements, and a pattern of the expected sensor output data that is expected to be outputted from the plurality of sensors and which corresponds to a position of each of the plurality of sensors with respect to each of the supposed defective states concerning the image-recording elements included in a image-recording element row corresponding to the plurality of sensors situated in the neighboring region.

27. The image recording apparatus as defined in claim 26, wherein the plurality of sensors respectively have read ranges which each correspond to a range of three dots arranged consecutively in the width direction on the printing medium and which overlap with each other between adjacent sensors of the plurality of sensors.

28. The image recording apparatus as defined in claim 26, wherein the defective image-recording element determining device determines the approximate position of the defective one of the plurality of image-recording elements according to the actual sensor output data obtained from each of the plurality of sensors of the image reading device and the expected sensor output data expected from the image to be normally recorded;

selects the image-recording elements situated near the determined, approximate position as the image-recording elements having the possibility of being the defective one of the plurality of image-recording elements; and determines the position of the defective image-recording element from among the positions of the image-recording elements having the possibility of being the defective one of the plurality of image-recording elements and the defective state of the defective one of the plurality of image-recording elements from among the supposed defective states that are supposed for each of the image-recording elements by comparing a pattern of the actual sensor output data of each of the sensors which are situated within a range corresponding to five of the image-recording elements centered around the image-recording elements selected as the image-recording elements having the possibility of being the defective one of the plurality of image-recording elements, and a pattern of the expected sensor output data that is expected to be outputted from the plurality of sensors and which corresponds to a position of each sensor of the plurality of sensors with respect to each of the supposed defective states concerning the image-recording elements included in a image-recording element row corresponding to the sensors which are situated within the range corresponding to the five of the image-recording elements centered around the image-recording elements selected as the image-recording elements having the possibility of being the defective one of the plurality of image-recording elements.

* * * * *